US009856655B2

(12) United States Patent
Knight et al.

(10) Patent No.: US 9,856,655 B2
(45) Date of Patent: Jan. 2, 2018

(54) MODULAR SYSTEM FOR CONTINUOUSLY INSULATING EXTERIOR WALLS OF A STRUCTURE AND SECURING EXTERIOR CLADDING TO THE STRUCTURE

(71) Applicant: Modern Framing Systems, LLC, Deer Park, WA (US)

(72) Inventors: Douglas James Knight, Clayton, WA (US); Brian Nelson, Spokane, WA (US)

(73) Assignee: MODERN FRAMING SYSTEMS, LLC, Deer Park, WA (US)

( * ) Notice: Subject to any disclaimer, the term of this patent is extended or adjusted under 35 U.S.C. 154(b) by 0 days.

(21) Appl. No.: 14/212,535

(22) Filed: Mar. 14, 2014

(65) Prior Publication Data

US 2015/0128518 A1 May 14, 2015

Related U.S. Application Data

(60) Provisional application No. 61/784,843, filed on Mar. 14, 2013.

(51) Int. Cl.

| | |
|---|---|
| ***E04B 2/30*** | (2006.01) |
| ***E04F 13/074*** | (2006.01) |
| ***E04F 13/08*** | (2006.01) |
| *E04B 2/44* | (2006.01) |

(52) U.S. Cl.

CPC ..... *E04F 13/0862* (2013.01); *E04F 13/0807* (2013.01); *E04F 13/0808* (2013.01); *E04F 13/0864* (2013.01); *E04B 2/30* (2013.01); *E04B 2/44* (2013.01)

(58) Field of Classification Search

CPC ..... E04B 2/30; E04B 2/44; E04B 2/46; E04F 13/0807; E04F 13/12; E04F 13/0853; E04F 13/074

USPC ..... 52/379, 506.05, 506.06, 378, 506.01, 52/745.05, 745.09, 745.15, 704, 698, 705, 52/511, 513

See application file for complete search history.

(56) References Cited

U.S. PATENT DOCUMENTS

| | | | | |
|---|---|---|---|---|
| 519,952 | A | 5/1894 | Hayes | |
| 2,696,281 | A | 12/1954 | Hedgren et al. | |
| 2,860,504 | A * | 11/1958 | Sinner et al. | 52/378 |
| 3,217,455 | A | 11/1965 | Burges | |
| 3,266,207 | A * | 8/1966 | Birum, Jr. | 52/459 |
| 3,427,775 | A | 2/1969 | Bachrich | |

(Continued)

FOREIGN PATENT DOCUMENTS

| | | |
|---|---|---|
| CH | 690967 | 3/2001 |
| DE | 2702459 | 7/1977 |

(Continued)

*Primary Examiner* — Phi A

(74) *Attorney, Agent, or Firm* — Dorsey & Whitney LLP

(57) ABSTRACT

A modular system for continuously insulating exterior walls of a structure and cladding the structure walls provides thermally isolated MFI-brackets secured to a structural wall supporting thermally isolated vertical or horizontal rails supporting exterior cladding. Thermal insulation is positionally retained against the structure wall interior of the exterior cladding by the MFI-brackets and a pressure equalized moisture controlling rain screen is maintained between the interior surface of the exterior cladding and an exterior facing surface of the insulation.

38 Claims, 11 Drawing Sheets

(56) References Cited

U.S. PATENT DOCUMENTS 3,839,839 A 10/1974 Tillisch et al. ..... 52/846
3,899,989 A 8/1975 Glazebrook
3,939,618 A 2/1976 Murphy
3,978,626 A 9/1976 Weinar
4,009,549 A 3/1977 Hala
4,044,511 A 8/1977 Lingle et al.
4,056,904 A 11/1977 Dawdy
4,067,163 A 1/1978 Hetman et al.
4,070,835 A * 1/1978 Reverend et al. ..... 52/235
4,074,486 A 2/1978 Grearson ..... 52/235
4,171,172 A * 10/1979 Johnston ..... A01B 35/30 172/202
4,250,678 A 2/1981 Skuran
4,346,543 A 8/1982 Wilson et al.
4,478,018 A 10/1984 Holand
4,506,482 A 3/1985 Pracht et al.
4,516,371 A 5/1985 Simpson et al.
4,523,413 A * 6/1985 Koppenberg ..... 52/139
4,571,909 A 2/1986 Berghuis et al.
4,566,239 A 3/1986 Smigel et al.
4,641,468 A 2/1987 Slater
4,646,498 A 3/1987 Schneller et al.
4,651,489 A 3/1987 Hodges et al.
4,669,235 A * 6/1987 Reinen ..... E04B 1/2608 403/403
4,680,905 A 7/1987 Rockar ..... 52/200
4,897,976 A 2/1990 Williams et al. ..... 52/281
5,063,722 A 11/1991 Hohmann
5,065,559 A 11/1991 Zegel et al. ..... 52/239
5,066,958 A 11/1991 Blachley et al.
5,092,100 A 3/1992 Lambert et al. ..... 52/774
5,094,052 A 3/1992 Gudmundsson et al. ... 52/238.1
5,216,859 A 6/1993 Moreno et al.
5,285,607 A 2/1994 Somerville
5,323,577 A * 6/1994 Whitmyer ..... 52/235
5,367,853 A * 11/1994 Bryan ..... E04B 5/14 52/289
5,379,561 A 1/1995 Saito ..... 52/235
5,417,050 A * 5/1995 Cosentino ..... 52/506.08
5,435,679 A 7/1995 Barry
5,473,851 A 12/1995 Northrup, Jr.
5,544,461 A * 8/1996 Sommerstein ..... 52/235
5,617,695 A 4/1997 Brimmer
5,619,834 A 4/1997 Chen
5,644,883 A 7/1997 Menchetti ..... 52/489.1
5,628,161 A 9/1997 Giannuzzi et al.
5,724,780 A 3/1998 Bolich et al.
5,749,192 A 5/1998 Menchetti ..... 52/489.1
5,758,464 A 6/1998 Hatton ..... 52/404.1
5,761,864 A 6/1998 Nonoshita ..... 52/302.3
5,799,454 A 9/1998 Andersson et al.
5,816,008 A * 10/1998 Hohmann ..... 52/565
5,857,817 A 1/1999 Giannuzzi et al.
5,924,256 A 6/1999 Ito
5,953,883 A 9/1999 Ojala ..... 52/794.1
5,970,671 A 10/1999 Bifano et al.
6,076,320 A 6/2000 Butler
6,094,883 A 8/2000 Atkins
6,125,608 A 10/2000 Charlson
6,128,883 A * 10/2000 Hatzinikolas ..... 52/698
6,138,423 A 10/2000 Poutanen et al.
6,209,281 B1 4/2001 Rice
6,230,467 B1 * 5/2001 Leek ..... E04B 1/2403 403/232.1
6,250,035 B1 6/2001 Bristow et al.
6,263,636 B1 7/2001 Corston
6,367,219 B1 * 4/2002 Quinlan ..... E04D 3/3602 52/404.2
6,401,417 B1 6/2002 Leblang
6,421,972 B1 7/2002 Dalphond et al.
6,502,362 B1 * 1/2003 Zambelli et al. ..... 52/698
6,594,965 B2 7/2003 Coulton
6,745,531 B1 6/2004 Egan
6,786,013 B2 9/2004 Coulton
6,944,997 B2 9/2005 Verkamp
7,024,825 B2 * 4/2006 Kebeli ..... E04B 7/045 52/712
7,043,844 B2 5/2006 Moreno
7,043,884 B2 5/2006 Moreno et al.
7,070,165 B2 7/2006 Jornod
7,127,858 B2 10/2006 Layfield
7,191,570 B1 3/2007 Eaton
7,254,925 B2 8/2007 Stefanutti et al.
7,421,826 B2 9/2008 Collins et al.
7,536,832 B2 5/2009 Deyoung
7,543,419 B2 6/2009 Rue
7,617,638 B1 11/2009 Slama et al.
7,712,273 B2 5/2010 Panasik
7,818,934 B2 10/2010 Hall et al.
7,823,357 B2 11/2010 Westra
7,895,803 B2 3/2011 Downey
8,037,653 B2 10/2011 Hohmann, Jr.
8,201,374 B2 * 6/2012 Hohmann, Jr. ..... 52/379
8,266,850 B2 9/2012 Neal et al.
8,407,957 B2 4/2013 McClure
8,429,866 B2 4/2013 Knight et al. ..... 52/479
8,511,036 B2 * 8/2013 O'Donnell ..... E04G 5/041 248/237
8,667,765 B1 * 3/2014 McCarthy ..... F16B 15/02 248/301
8,683,772 B2 * 4/2014 Friis ..... E04B 7/022 52/691
8,720,141 B2 5/2014 Shembekar et al.
8,739,494 B2 6/2014 Francavilla
8,826,624 B2 * 9/2014 Dalen ..... 52/704
8,839,587 B2 * 9/2014 Hohmann, Jr. ..... 52/700
8,973,334 B2 3/2015 Croasdale
2002/0194805 A1 12/2002 Arseneau et al.
2003/0037499 A1 2/2003 Coulton
2003/0070388 A1 * 4/2003 Catani ..... E04C 5/16 52/677
2004/0006942 A1 1/2004 Greenway
2004/0055236 A1 3/2004 Keith
2004/0216408 A1 11/2004 Hohmann, Jr.
2004/0217320 A1 11/2004 Jornod
2004/0221518 A1 11/2004 Westra
2005/0011154 A1 1/2005 Kim et al.
2005/0034386 A1 2/2005 Crandell et al.
2005/0076592 A1 * 4/2005 Kebeli ..... E04B 7/045 52/364
2005/0204660 A1 9/2005 Tiirola
2005/0284053 A1 12/2005 Grunewald et al.
2006/0080917 A1 4/2006 Hall et al.
2007/0068111 A1 * 3/2007 Buntain ..... E04B 1/7612 52/699
2007/0193151 A1 8/2007 Anderson
2007/0204541 A1 9/2007 Sade
2007/0207305 A1 9/2007 Hord et al.
2008/0245001 A1 10/2008 Alkoury et al.
2009/0000244 A1 1/2009 O'Neal
2009/0094923 A1 4/2009 Weir et al.
2010/0005749 A1 1/2010 Abdel-Sayed et al.
2010/0025984 A1 2/2010 Kullen et al.
2010/0037552 A1 2/2010 Bronner
2010/0083606 A1 4/2010 Davis et al.
2010/0146893 A1 6/2010 Dickinson
2010/0175344 A1 * 7/2010 Gadd ..... E04B 1/2612 52/655.1
2010/0287865 A1 11/2010 Hatzinikolas
2011/0047919 A1 3/2011 Hohmann, Jr.
2011/0296781 A1 12/2011 McCary
2012/0031019 A1 2/2012 Stearns et al.
2012/0227342 A1 3/2012 McClure
2012/0124930 A1 5/2012 McClure
2012/0131872 A1 5/2012 Kim
2012/0180422 A1 * 7/2012 Noturno ..... E04G 21/1891 52/696
2012/0192516 A1 8/2012 Hillers
2012/0260596 A1 * 10/2012 Boese ..... E04B 1/16 52/426
2012/0304576 A1 12/2012 Hohmann, Jr.
2012/0308330 A1 12/2012 Hohmann, Jr.

(56) References Cited

U.S. PATENT DOCUMENTS

| | | | |
|---|---|---|---|
| 2013/0008121 | A1 | 1/2013 | Dalen |
| 2014/0208681 | A1 | 7/2014 | Rice |
| 2014/0325928 | A1 | 11/2014 | White et al. |
| 2014/0353435 | A1 | 12/2014 | Liu et al. |
| 2015/0176268 | A1 | 6/2015 | Knight et al. |

FOREIGN PATENT DOCUMENTS

| | | | |
|---|---|---|---|
| DE | 3215392 | A1 | 10/1983 |
| DE | 3215932 | | 10/1983 |
| EP | 1233118 | A2 | 8/2002 |
| EP | 1310612 | A2 | 5/2003 |

* cited by examiner 200
201
202
203
204
205
206
207
208
70
71
72
74
75
76
77
78
30
25
26
27
28
33
34
35
36
38
39
40
42
31
180
181
182
183
184
185
187
189
190

MODULAR SYSTEM FOR CONTINUOUSLY INSULATING EXTERIOR WALLS OF A STRUCTURE AND SECURING EXTERIOR CLADDING TO THE STRUCTURE

RELATED APPLICATIONS

This Utility Patent Application claims the benefit of earlier filed U.S. Provisional Patent Application No. 61/784,843, filed on Mar. 14, 2013 and titled IMPROVED MODULAR SYSTEM FOR CONTINUOUSLY INSULATING EXTERIOR WALLS OF A STRUCTURE AND SECURING EXTERIOR CLADDING TO THE STRUCTURE. The entire contents of the earlier filed U.S. 61/789,843 is expressly incorporated herein by this reference.

BACKGROUND OF INVENTION

1. Field of Invention

This invention relates to static structures, and more particularly to an improved modular system for mounting and supporting continuous thermal insulation and exterior cladding on a structure while providing a rain screen between the continuous thermal insulation and the exterior cladding, providing a for vertical and horizontal re-plumbing of exterior cladding and eliminating thermal conductivity from the exterior of the structure to the interior of the structure, and visa-versa.

2. Background and Description of Prior Art

It is well known in the construction field to build structure walls with plural spaced apart parallel vertical studs of wood or metal. The studs communicate, at a bottom end portion with a wall plate that is anchored to a lower support which may be a building foundation, and at an upper end portion with a ceiling plate that extends generally perpendicular to the studs and parallel with the wall plate. A weather resistive barrier formed of material such as asphalt impregnated paper, plastic sheeting, building wrap or similar product may be attached to exterior facing edges of the wall studs, extending from stud to stud and from floor plate to ceiling plate. The weather resistive barrier inhibits flow of air and moisture through any gaps that may exist in the wall assembly.

Sheathing formed of materials such as, but not limited to, plywood, oriented strand board (OSB), wafer board, metallic sheeting, lapboard, gypsum sheathing and the like, may be fastened to the outward facing edges of the wall studs outward of the weather resistive barrier. The sheathing also typically extends from wall stud to wall stud and from the wall plate to the ceiling plate. The sheathing may provide the exterior surface of the structure or may itself be covered with another exterior cladding, exterior covering or exterior coating.

Services such as plumbing, electrical, tele-communications and the like may be provided for by forming generally horizontally aligned holes in the studs and placing conduit, or the like, through the horizontally aligned holes. Thereafter, wiring, pipes and the like may be threaded into and through the conduit or directly through the generally horizontally aligned holes.

Commonly, interior insulation is installed directly against interior facing surface of the weather resistive barrier in the spaces between the wall studs extending from the floor plate to the ceiling plate. The insulation may be of various forms including fiberglass batting, mineral wool, recycled paper, cellulose or the like. The object is to "fill" the space between the wall studs extending from the floor plate to the ceiling plate to limit thermal transfer from the interior of the structure wall to the exterior of the structure wall, and visa versa depending upon the structure's interior operating conditions and the outside climate.

A vapor barrier such as plastic sheeting or the like may be attached to the interior facing edges of the wall studs extending from wall stud to wall stud and from the ceiling plate to the floor plate enclosing the insulation between the wall studs and between the inner vapor barrier and outer weather resistive barrier.

Interior sheathing, such as drywall, gypsum board, paneling or the like is attached to the inward facing edge portions of the wall studs, the floor plate and the ceiling plate and access holes are cut in the interior sheathing to provide access to the electrical boxes, plumbing fittings and the like.

One drawback to such wall assemblies and framing methods is that such methods create thermal bridges in the structure's walls which decrease the effectiveness of the insulation and allows thermal energy to be conducted through the wall assembly from the inside to the outside, and from the outside to the inside depending upon the outside temperatures and the inside operating conditions.

Although insulation is provided between the wall studs between the exterior sheathing and the interior sheathing, the studs themselves provide little insulative value and walls formed by such methods are not thermally efficient because thermal transfer occurs through the wall studs which act as "thermal bridges". When metal wall studs are used, such as those commonly used in commercial construction, the effectiveness of insulation between the metal wall studs may be reduced by more than fifty percent (50%).

For example, a wall assembly having exterior OSB sheathing and interior gypsum board sheathing supported by plural parallel spaced apart 2"×6" wood wall studs therebetween and having T-21 rated fiberglass batting type insulation filling the spaces between the wood wall studs has an effective R-rating of approximately R-18 due to the thermal transfer through the wood wall studs. If the same wall assembly is constructed using steel wall studs between the exterior OSB cladding and the interior gypsum board sheathing the effective R-value drops to approximately R-8 because of the thermal loss through the steel wall studs.

Even when additional layers of thermal insulation are placed on the exterior of a structure, (adjacent to the exterior facing surface of the exterior cladding) the insulative effectiveness of such additional insulation is reduced by the common practice of attaching exterior cladding directly to the outward facing surface of the additional insulation with metal attachment means or framing elements that penetrate through the insulation thereunder to engage with the underlying wall studs to provide support for the exterior cladding.

Attaching additional insulation to the exterior of a structure is also known to cause condensation within the wall assembly, which occurs when moisture-laden air comes into contact with a surface having a temperature below the dew-point temperature of the moisture-laden air. In a wall assembly, condensation usually occurs during the cold weather months on the interior facing surface of the exterior cladding when warm moisture laden air from the interior of the structure penetrates the wall assembly and contacts, the cold interior facing surface of the exterior cladding. In warm weather months, the condensation usually forms on the exterior facing surface of the insulation by warm air penetrating the wall from the outside and contacting the cooler exterior facing surface of the insulation which can lead to moisture saturation of the insulation which degrades the effectiveness of the insulation. Without proper design and engineering, attaching insulation directly to the exterior of a structure can be ineffective and can even be detrimental to the useful life of the wall assembly as condensation can lead to rod, no, insect infestation and diminished insulative effectiveness.

Another drawback to such construction methods is the limited number of options for cladding the exterior of a light-frame structure. Although some exterior claddings are available, such as lap board, metal siding, paneling and the like, such cladding is typically limited to light-weight coverings that can be supported by hanger-type wall attachments. Cladding exterior walls with heavy materials such as brick, stone and the like has previously been difficult because the weight of such coverings must be supported by the wall attachments. Overcoming this difficulty leads to additional costs and expenses for larger foundations for vertical support, stronger beams for horizontal support and additional labor costs.

A further drawback to such construction methods is the limited ability to refurbish existing structures by changing the exterior. Generally, when an existing structure is "re-clad" the options available are limited to replacing the existing cladding, or fastening a light weight cladding over the top of the existing cladding. Unfortunately, at times this is not feasible because the existing cladding is too deteriorated to allow stable attachment of the new cladding system. Further, in some instances the vertical "plumbness" or planar nature of an exterior wall might be so poor that it is not feasible or practical to attach a new exterior cladding to the existing structure. Finally, attaching a new exterior cladding has the ability to alter the building's "footprint" sufficiently to cause property line set-back problems by extending the building's walls outwardly.

Evolving construction standards with increased emphasis on energy efficiency, "being green" and limiting greenhouse gas emissions have required construction methods and techniques to likewise change to focus on the energy efficiency of structures. One way to increase the energy efficiency of a structure is to add insulation to the structure walls. Another is to minimize, or if possible eliminate thermal bridges that allow energy loss. A third is to improve moisture management which improves durability and thermal performance of the wall assembly. An even more effective solution is to do all three; add insulation to the structure while effectively managing moisture and eliminating and minimizing thermal bridges. The combination of these efforts is known as "continuous insulation" which is defined in various building codes, such as, but not limited to, ASHREA 90.1 as insulation that is uninterrupted by framing members, except fasteners (screws, nails) and is installed either inboard or outboard of the wall.

The precise definition of "Continuous Insulation" as set forth in the proposed Seattle Energy Code of 29 Apr. 2010 with which Applicants are most familiar, defines continuous insulation as follows:

> CONTINUOUS INSULATION (C.I): Insulation that is continuous across all structural members without thermal bridges other than fasteners (i.e., screws and nails) and service openings. It is installed on the interior or exterior or is integral to any opaque surface of the building envelope. Insulation installed between metal studs, z-girts, z-channels, shelf angles, or insulation with penetrations by brick ties and offset brackets, or any other similar framing is not considered continuous insulation, regardless of whether the metal is continuous or occasionally discontinuous or has thermal break material.

What is needed is a system that allows exterior cladding to be installed on new structures and onto existing structures, and allows the walls to be insulated having a high degree of effective thermal insulation while minimizing or eliminating thermal bridges and moisture management problems. The system must accommodate a variety of exterior claddings and must allow the structure to be provided with a new appearance, including an appearance of being constructed of masonry, stone or the like. The system must comply with evolving construction standards including the new ASHRE 90.1 standards, including the standards for continuous installation. The system must be economical and efficient and provide sufficient flexibility and structural integrity to allow a user to clad the exterior of a structure as desired and simultaneously preserve the desirable features of known light frame construction methods and systems.

Our system overcomes various drawbacks of known construction apparatus, methods and techniques by providing an improved modular system that preserves user flexibility in the exterior cladding of a structure and maximizes the insulative capabilities by providing a continuously insulated structure having no or minimal thermal bridges that allow thermal energy loss.

Our system provides unique MFI-brackets that are attached to the underlying structure in a manner that the MFI-brackets are thermally isolated from the underlying structure to prevent creation of thermal bridges. The configuration of the MFI-brackets secures nonflammable/non-combustible insulation adjacent to the structure and provides a support for exterior cladding which may be either directly or indirectly mounted thereto.

An exterior cladding supporting system fastened to outward end portions of the MFI-brackets provides a vertical rail or horizontal rail upon which exterior cladding may be releasably secured. A desired exterior cladding may be fastened to exterior facing portions of the vertical rails and/or horizontal rails. Corner elements carrying complimentary sections of the desired exterior cladding are supported by the system at the structure corners.

A rain screen between an Interior facing surface of the exterior cladding and the exterior facing surface of the insulation provides a pressure equalized drain cavity that prevents moisture from passing from the exterior into the wall assembly, reduces condensation, and properly manages moisture. The pressure equalized drain cavity is configured to comply with fire standards to prevent formation of a "chimney" between the Interior facing surface of the exterior wall cladding and the exterior facing surface of the insulation.

Thermal isolators reduce thermal transfer between interconnecting elements by preventing metal to metal connections and the MFI-brackets provide a tapered down "bottle neck" that further reduces thermal transfer between the exterior cladding and the underlying structure and maximizes the effectiveness of the insulation.

Spacers optionally positioned between the thermal isolators and a wall assembly provide a means to adjust and repair the vertical plumbness and planar configuration of a wall assembly.

Our system increases the "effective R Value" of structures by providing a more energy efficient wall structure that loses less heat through thermal conduction through the wall structure.

Our system reduces moisture condensation within the wall assembly effectively manages moisture and minimizes energy losses related to thermal bridging.

Our system meets and exceeds evolving and changing building codes and regulations, such as but not limited to ASHRAE 90.1 standards which are the baseline energy efficiency guidelines used worldwide for promotion of energy efficiency, energy conservation and "greenness".

Our system allows the exterior of a structure to be clad in a material that has the appearance and texture of masonry, stone and the like, without the weight of such construction and without the required foundation and other underlying support structures and construction costs that would be necessary to support construction with such heavy materials.

Our invention does not reside in any one of the identified features individually, but rather in the synergistic combination of all of its structures, which give rise to the functions necessarily flowing therefrom as hereinafter specified and claimed.

SUMMARY

A modular system for continuously insulating exterior walls of a structure and securing exterior cladding to the structure provides thermally isolated MFI-brackets secured to a structure exterior wall that positionally maintain non-flammable insulation adjacent the structure wall and provide a means for mounting exterior wall cladding to the structure. Exterior cladding elements mount directly or indirectly to thermally isolated vertical rails or thermally isolated horizontal rails carried by the MFI-brackets spaced apart from the exterior wall.

In providing such a modular system it is:

a principal object to provide a modular system for insulating a structure wall and supporting exterior wall cladding.

a further object to provide a modular system that minimizes thermal transfer from the exterior of a wall to the interior of a wall and from the interior of a wall to the exterior of a wall.

a further object to provide a modular system that complies with building codes for energy efficiency, thermal energy savings and "greenness".

a further object to provide a modular system that thermally isolates the MFI-brackets from the structure wall.

a further object to provide a modular system that prevents penetration and passage of moisture into the structure wall.

a further object to provide a modular system that may be installed on a new structure.

a further object to provide a modular system that may be installed on an existing structure.

a further object to provide a modular system that supports a variety of exterior claddings.

a further object to provide a modular system that decreases the cost of insulating a structure and increases the effectiveness of the insulation.

a further object to provide a modular system that allows a structure's exterior walls to be re-plumbed to vertical.

a further object to provide a modular system that allows a structure's exterior walls to be replumbed to vertical and planar.

a further object to provide a modular system that uses interchangeable parts and is mountable vertically as well as horizontally.

a further object to provide a modular system that uses vertical rails and horizontal rails that are interchangeable.

a further object to provide a modular system wherein a cross-sectional profile of the vertical rail and horizontal rail may be modified to accommodate various types of exterior cladding.

a further object to provide a modular system wherein the length of the MFI-brackets may be adjusted to accommodate differing thicknesses of insulation.

a further object to provide a modular system that is completely thermally isolated and satisfies the definitions of "continuous insulation".

a further object to provide a modular system that is ASHRE 90.1 compliant.

a further object to provide a modular system that supports masonry cladding.

a further object to provide a modular system that supports stone cladding.

a further object to provide modular system that eliminates the need for massive foundations to support the weight of heavy cladding.

a further object to provide a modular system that reduces condensation within the wall assembly and effectively manages moisture within the wall assembly.

a still further object to provide a modular system that meets building standards for continuous insulation.

a further object to provide a modular system having minimal components.

a further object to provide a modular system where the components are assembled at the manufacturer to avoid the need to assemble components at the construction site.

a further object to provide a modular system that is adjustable to replumb walls to vertical and/or planar.

a still further object to provide a modular system that utilizes non-flammable insulation to reduce fire risk.

Other and further objects of our invention will appear from the following specification and accompanying drawings which form a part hereof. In carrying out the objects of our invention it is to be understood that its structures and features and steps are susceptible to change in design and arrangement and order with only one preferred and practical embodiment of the best known mode being illustrated in the accompanying drawings and specified as is required.

BRIEF DESCRIPTIONS OF DRAWINGS

Specific forms, configurations, embodiments and/or diagrams relating to and helping to describe preferred embodiments of the invention are explained and characterized herein, often with reference to the accompanying drawings. The drawings and all features shown therein also serve as part of the disclosure of our invention whether described in text or merely by graphical disclosure alone. Such drawings are briefly described below and wherein like numbers refer to similar parts throughout:

DETAILED DESCRIPTION OF THE PREFERRED EMBODIMENTS

Introductory Notes

Figure 1:
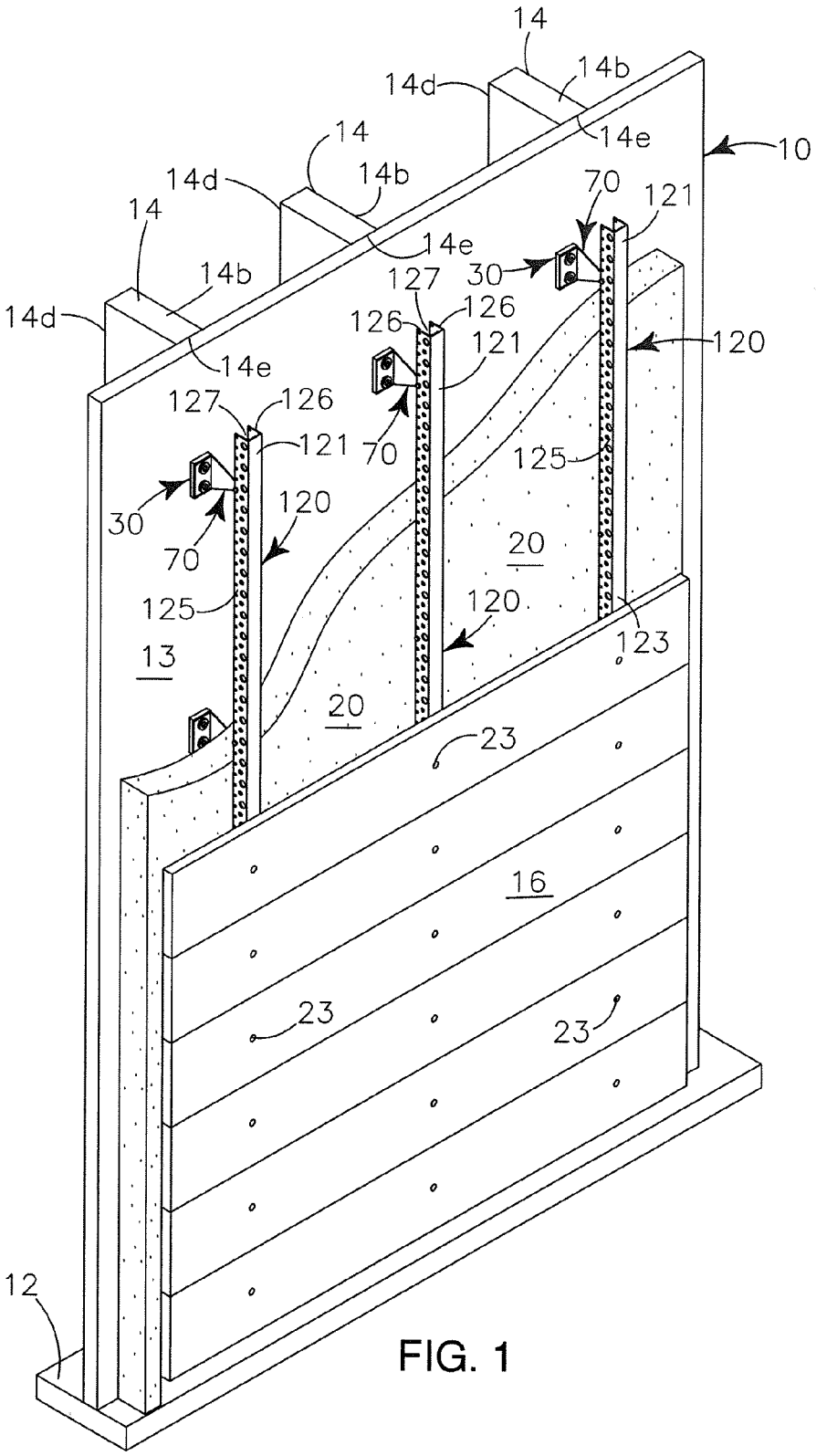
FIG. 1 is an isometric partial cutaway exterior view of a partially insulated and partially clad wall assembly showing plural spacedly arrayed thermally isolated MFI-brackets mounted to the structure wall supporting vertical rails spaced apart from the structure wall and maintaining insulation adjacent the structure wall and exterior cladding mounted to the vertical rails.

The readers of this document should understand that the embodiments described herein may rely on terminology used in any section of this document and other terms readily apparent from the drawings and the language common therefore as may be known in a particular art and such as known or indicated or provided by dictionaries. Widely known and used in the preparation hereof are Webster's Third New International Dictionary (©1993), The Oxford English Dictionary (Second Edition, ©1989), The New Century Dictionary (©2001-2005) and the American Heritage Dictionary of the English Language (4th Edition ©2000) all of which are hereby incorporated by reference for interpretation of terms used herein and to more adequately or aptly describe various features, aspects and concepts shown or otherwise described herein.

This document is premised upon using one or more terms for features shown in one embodiment that may also apply to or be combined with other embodiments for similar structures, functions, features and aspects of the invention. Wording used in the claims is also descriptive of the invention and the text of both the claims and the abstract are incorporated by reference into the description entirely.

The readers of this document should further understand that the embodiments described herein may rely on terminology and features used in any section or embodiment shown in this document and other terms readily apparent from the drawings and language common or proper therefore.

As used herein, the term "outer", its derivatives and grammatical equivalents refers to that portion of our improved modular system that is proximate an exterior of a structure. The term "inner", its derivatives and grammatical equivalents refers to that portion of our modular system that is proximate an interior of the structure. The term "lower", its derivatives and grammatical equivalents refers to that portion of our modular system that is vertically proximate a foundation of the structure. The term "upper" its derivatives and grammatical equivalents refers to that portion of our modular system that is vertically distal from the foundation of the structure.

Our modular system for continuously insulating exterior walls of a structure and securing exterior cladding to the structure generally provides MFI-brackets 70, bracket isolators 30, cap isolators 50, shims 180, vertical rails 120, horizontal rails 140, insulation 20 and exterior cladding 16.

As shown in FIG. 1, a wall assembly 10 is commonly formed of plural spaced apart vertical wall studs 14 that communicate between a wall plate 12 at a lower end portion and a ceiling plate (not shown) at a upper end portion 14*b*. The studs 14 may be formed of a variety of materials including but not limited to steel, aluminum, wood, plastic and composite and are rigidly interconnected to the wall plate 12 and to the ceiling plate (not shown) by known means. The wall plate 12 may communicate with a structure foundation (not shown) which provides vertical support for the wall assembly 10, or the wall plate 12 may be supported by a floor portion (not shown) when the structure has more than one level. Adjoining walls (not shown) are typically formed by the same methods and with the same materials and communicate with first wall 10 at adjacent edge portions forming corners which may form any of a variety of angles. Window openings (not shown) and door openings (not shown) may be defined in the wall assembly 10 by adjusting placement of the wall studs 14 and by installing sills (not shown) communicating between the wall studs 14.

Each wall stud 14 has an interior facing edge portion 14*d* and an opposing exterior facing edge portion 14*e*. Utility holes (not shown) may be formed in each wall stud 14 for passage of conduit (not shown) and the like therethrough. Utility boxes (not shown) for light switches, electrical outlets and the like may be spacedly arrayed about the wall studs 14.

Depending upon the construction technique being used, and the engineering and architectural design for the wall assembly 10, sheathing 21 such as plywood, oriented strand board (OSB), or the like may be attached to the exterior facing edge portions 14*e* of the wall studs 14 prior to installation of a weather resistant barrier (not shown) and prior to installation of insulation 20.

The insulation 20 is thermally resistant, nonflammable and is non-combustible and in the preferred embodiment is formed of mineral wool, examples of which include, but are not limited to, mineral fiber, rock wool, stone wool and slag wool, some of which are made by the Thermafiber™ Company of Wabash, Ind., and the Roxul™ Company of Milton, Ontario, Canada. Other examples of contemplated insulation 20 include fiberglass insulation, fiberglass batting and rigid thermally isolating panels.

Mineral wool is a known furnace product of molten rock that is formed at a temperature of approximately 1600° C. through which a stream of pressurized air or steam is blown creating a mass of fine, intertwined fibers with a diameter of approximately 6 to 10 μm. Production techniques may involve spinning molten rock on high-speed spinning wheels somewhat like the process used to prepare "cotton candy". Mineral wool may also contain a binder, often food grade starch and oil to reduce dusting.

The insulation 20 provides a thermal barrier that inhibits thermal conductivity and provides additional protection from moisture penetration to reduce condensation and moisture related problems within the wall 10 assembly. Mineral wool is also widely recognized for its sound absorbing capabilities.

Thickness (interior surface to exterior surface) of the insulation 20 may be varied to adjust for the model MFI-bracket 70 used for the desired thermal resistance, sound absorbance and resistance to moisture penetration. Common thicknesses are 2", 4", 6", 8" and 10." The mineral wool insulation 20 is generally manufactured in rolls or sheets having a common width of 16", 18", and 24" inches that corresponds with common center-to-center spacing of wall studs 14 in a wall assembly 10. Although mineral wool is preferred, it is contemplated that other thermal insulation products, having similar characteristics of fire resistance, sound absorbance, resistance to thermal conductivity, ease of cutting, flame resistance, resistance to moisture penetration, and the like may similarly be used, examples of which include fiberglass insulation, fiberglass batting and rigid insulative foam panels such as those made by DOW® Chemical Company.

Figure 2:
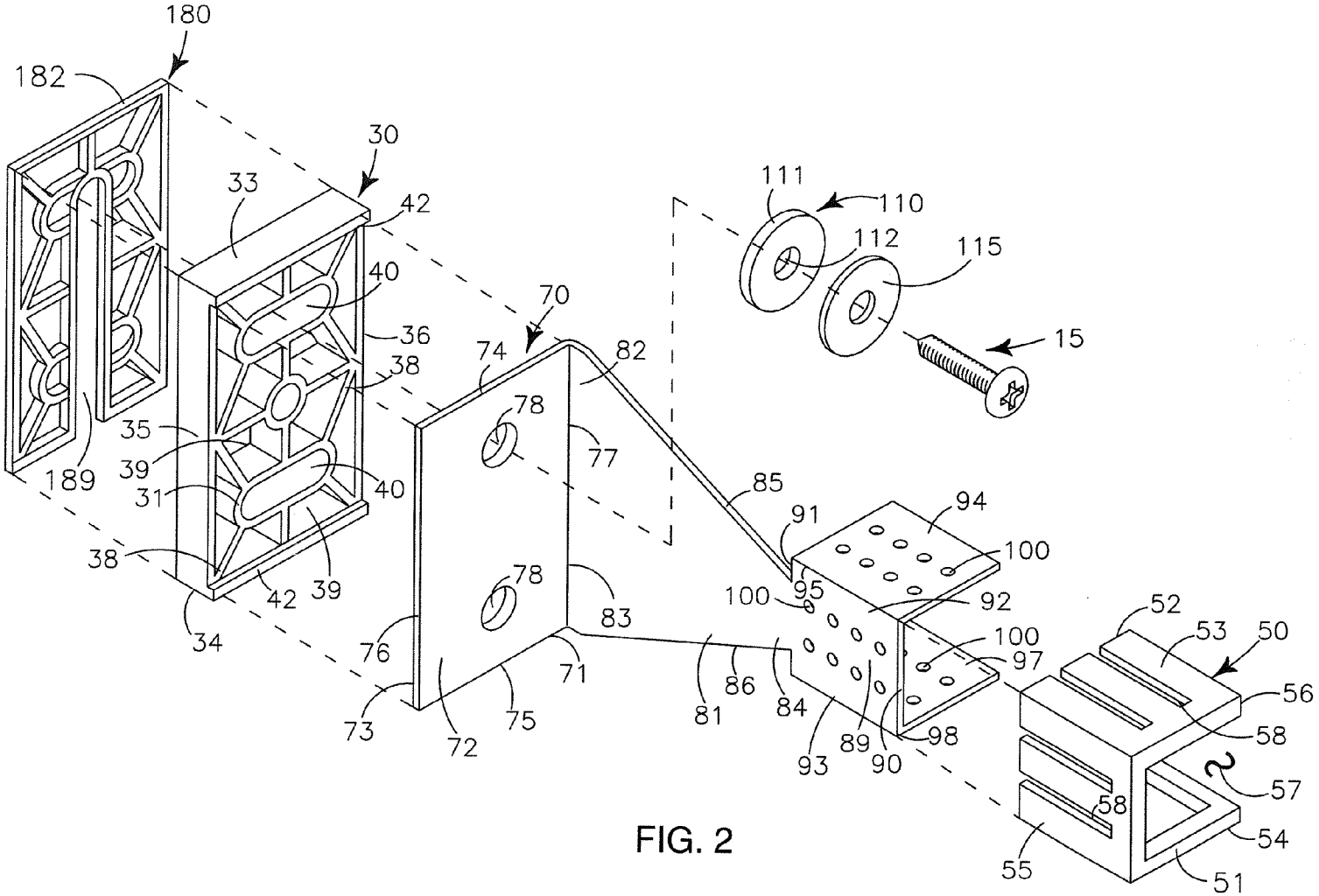
FIG. 2 is an exploded isometric top, front and side view of a MFI-bracket, a bracket isolator, a shim, a cap isolator, a button and a threaded fastener with washer showing how the components align and interconnect.
Figure 3:
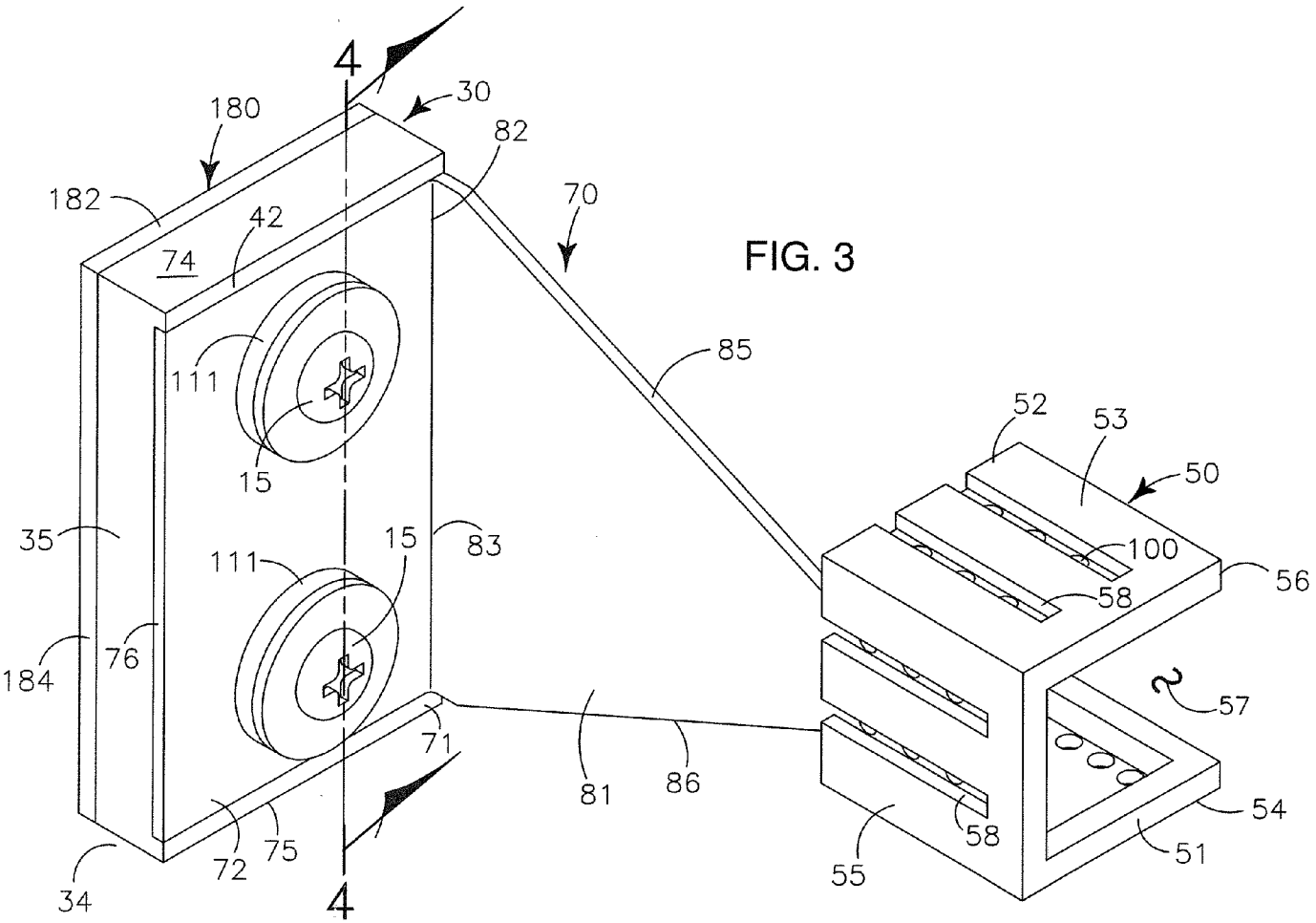
FIG. 3 is an isometric top, front and side view, similar to that of FIG. 2, showing the MFI-bracket, bracket isolator, shim, cap isolator, button and fastener assembled.
Figure 4:
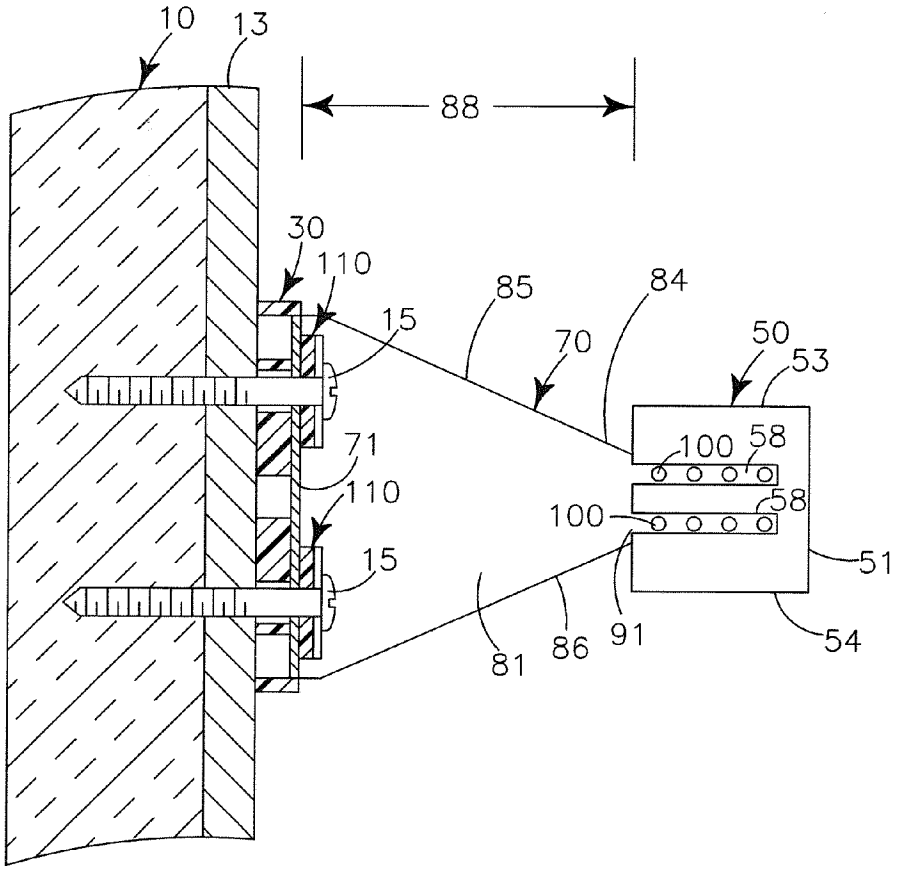
FIG. 4 is an orthographic cross section side view of the MFI-bracket of FIG. 3 taken on line 4-4 of FIG. 3, less the shim, mounted to a wall and showing the complete thermal isolation of the components.
Figure 5:
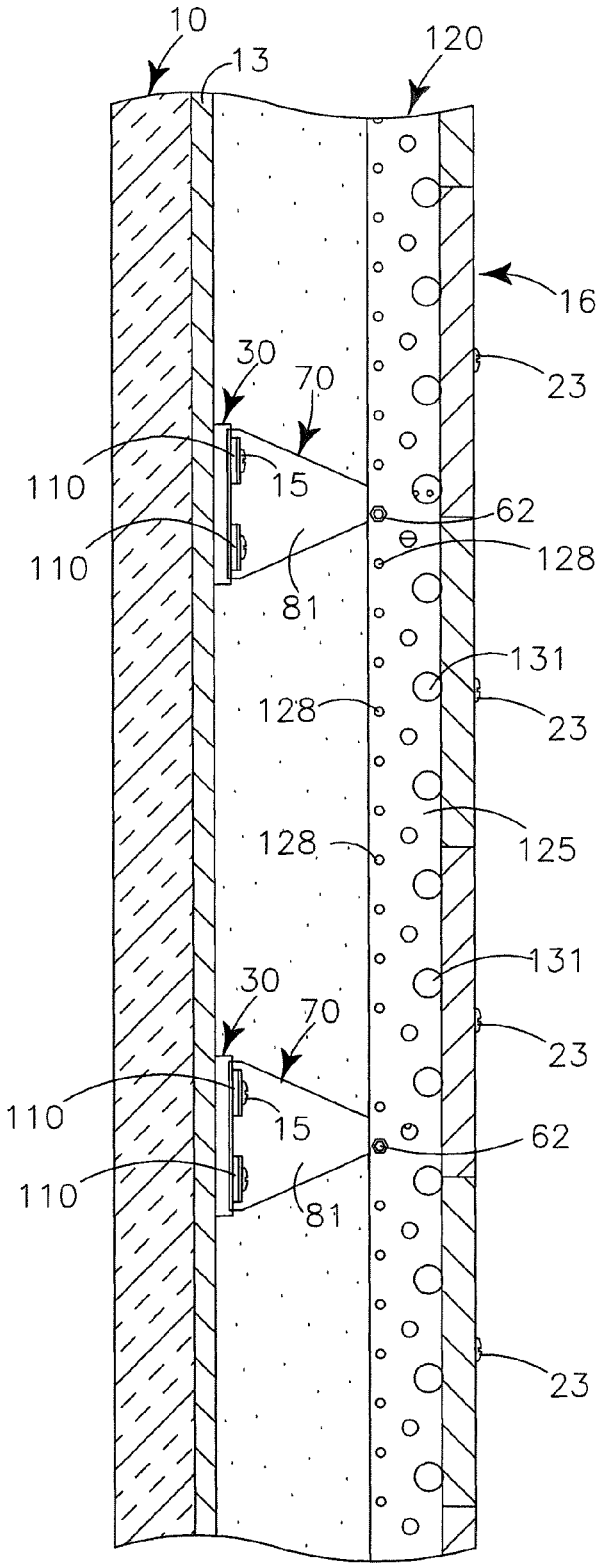
FIG. 5 is an orthographic side view of a wall assembly showing plural MFI-brackets supporting a vertical rail spaced apart from the structure wall thermal insulation and exterior cladding fastened to the vertical rail.
Figure 6:
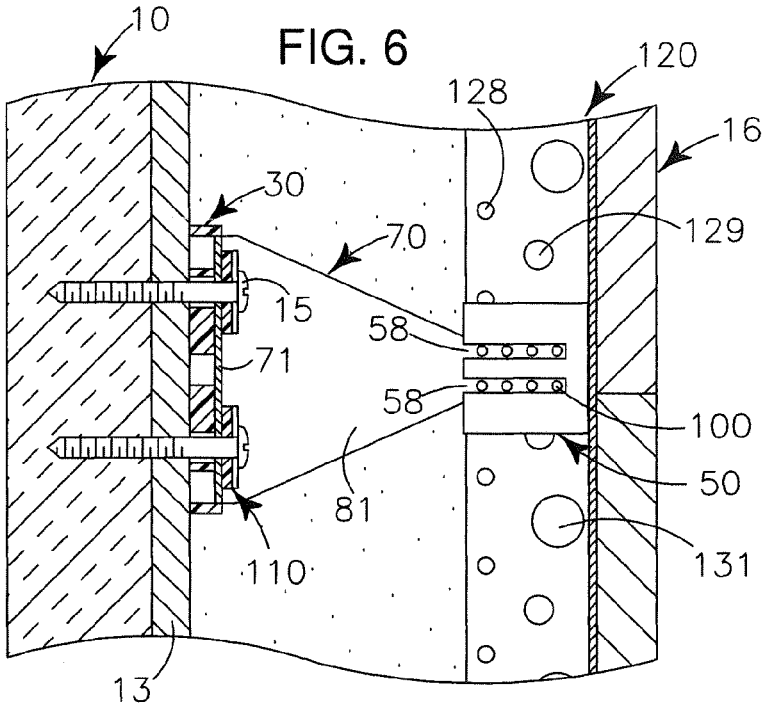
FIG. 6 is an enlarged orthographic partial cross section side view of a MFI-bracket mounted to a wall showing a vertical rail interconnected with the MFI-bracket and exterior cladding mounted to the vertical rail.
Figure 7:
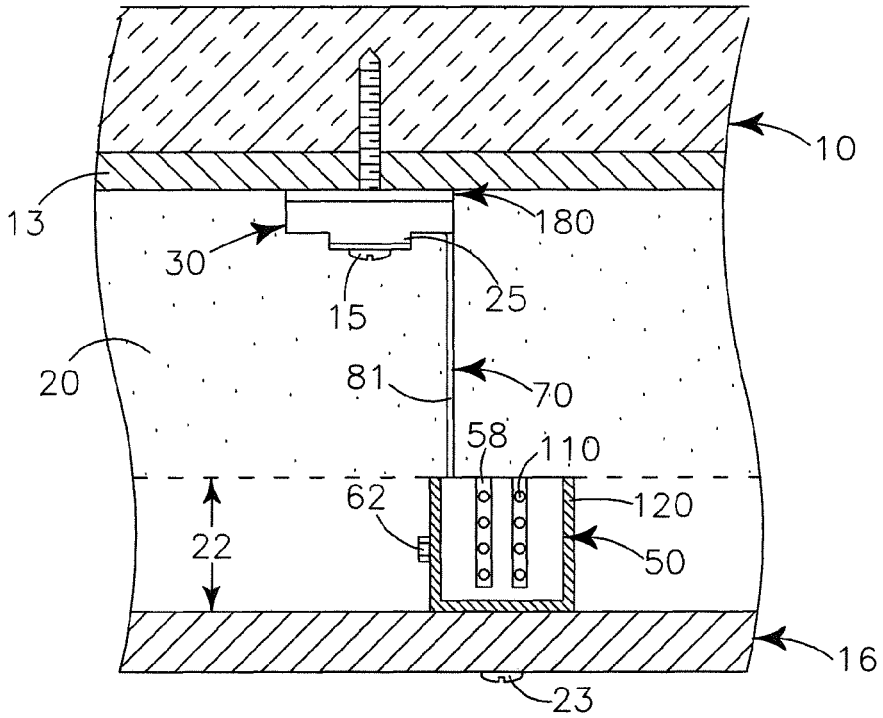
FIG. 7 is an enlarged orthographic partial cross section top, downward looking view of the MFI-bracket of FIG. 6.

MFI-bracket 70, (FIGS. 2-5), has a base 71, a spacing arm 81 and a tip portion 89 opposite from and spaced apart from the base 71. The base 71 is rectilinear and planar and has a front portion 72, a rear portion 73, a top portion 74, a bottom portion 75, a first lateral side 76, a second lateral side 77 at a bend 83 and defines fastener holes 78 therein. Spacing arm 81 has a base end portion 82 which structurally interconnects with the base 71 at bend 83 at the second lateral side 77, a tip end portion 84, a top edge 85 and a bottom edge 86. The spacing arm 81 tapers inwardly from the base end portion 82 toward the tip end portion 84 providing a generally triangular configuration. (FIGS. 2, 3). The tip end portion 89 is spaced apart from the base 71 by distance 88 (FIG. 4). Distance 88 is dependent upon the model MFI-bracket 70 used for a particular installation. For example, if four inch thick insulation is to be used, distance 88 would be four inches as a MFI-bracket 70 having spacing arm 81 that is four inches in length would be used. The tip portion 89 has a front portion 90, a rear portion 91 a top portion 92, a bottom portion 93, a first upper wing 94 structurally interconnected with the top portion 92 at bend 95 and a second lower wing 97 structurally interconnected with the bottom portion 93 at bend 98. Plural spacedly arrayed fastener holes 100 are defined in the tip 89, the first upper wing 94 and the second lower wing 97 to provide adjustability for mounting rails 120, 140 thereto. The first upper wing 94 and the second lower wing 97 extend laterally generally perpendicular to the tip 89 toward a side portion of the spacing arm 81 opposite the base 71.

Inward taper of the spacing arm 81 from the base 71 toward the tip 89 minimizes thermal conductivity from the base end portion 82 to the tip end portion 84 by reducing surface area. The bends 83, 95 and 98 are preferably 90° right angles, and the MFI-bracket 70 preferably has a uniform thickness of approximately 0.068" throughout and in the preferred embodiment is formed of 14 gauge steel, chemically treated A792 SS Gr. 50 Class 2 Galvalume×48" AZ55.

Bracket isolator 30 (FIGS. 2, 12) is preferably formed of polyoxymethylene F3001, having a commercial name of CelconR® acetal copolymer M-90 GP manufactured by Celanese®-Ticonia® LTD of Irvine Tex. This material is preferred because of its thermally insulative characteristics, its strength, its resistance to compression and its durability. The bracket isolator 30 is generally rectilinear in peripheral configuration having a front side 31, a rear side (not shown), a top portion 33, a bottom portion 34, a first lateral side 35, a second lateral side 36 and plural spacedly arrayed interior webs 38 with spaces 39 defined between the interior webs 38. Horizontally elongated fastener holes 40 are defined within the bracket isolator 30 by the interior webs 38. Edge lip 42 on the front side 31 at the top portion 33 and at the bottom portion 34 extends forwardly from the front-side 31 and is configured to frictionally engage with the top and bottom portions 74, 75 respectively of the base 71 of the MFI-bracket 70. The side-to-side, and top-to-bottom dimensions of the bracket isolator 30 correspond with the dimensions of the base 71 of the MFI-bracket 70 so that the fastener holes 78 defined in the base 71 align with the fastener holes 40 defined in the bracket isolator 30.

The edge lips 42 of the bracket isolator 30 provide a means for the bracket isolator 30 to be attached to the MFI-brackets 70 at the fabricator to form a single unit which eliminates the need for an installer to handle and align each MFI-bracket 70 with a bracket isolator 30 during installation of the wall system which promotes efficiency.

Cap isolator 50 (FIG. 2, is also formed of polyoxymethylene and is releasably carried on the tip 89 of the MFI-bracket 70 and extends thereover and thereabout. The cap isolator 50 is somewhat "C" shaped having a front portion 51, a rear portion 52, top portion 53, a bottom portion 54, a first lateral side portion 55, second lateral side portion 56 and defines a bracket cavity 57 in which the tip 89 of the MFI-bracket 70 is carried. Parallel spaced apart fastener slots 58 are defined in the top portion 53, bottom portion 54 and first lateral side portion 55 and each fastener slot 58 communicates with the rear portion 52 but not the front portion 51. The fastener slots 58 align with the plural spacedly arrayed fastener holes 100 defined in the tip 89, the first upper wing 94 and the second lower wing 97. The cap isolator 50 thermally isolates the MFI-bracket 70 from any element carried by the MFI-brackets 70 such as, but not limited to, vertical rail 120 and horizontal rail 140.

The plurality of fastener holes 100 defined in the tip 89 and first and second wings 94, 97 respectively of the MFI-bracket 70 as well as the elongated fastener slots 58 defined in the cap isolator 50 provide a means for adjustably "plumbing" the wall cladding system to vertical and/or planar by moving the rail 120, 140 closer to the wall assembly 10 or further away from the wall assembly 10 as necessary to change the angle of the rail 120, 140 relative to the wall assembly 10.

The shim 180 (FIG. 12) is similarly preferably also formed of polyoxymethylene F3001. The shim 180 is peripherally similar in configuration to the bracket isolator 30 having a height and width dimensions that match the rear side (not shown) of the bracket isolator 30. The shim 180 has a front side 181, a rear side (not shown), a top portion 182, a bottom portion 183, a first lateral side 184, a second lateral side 185 and has plural spacedly arrayed interior webs 187 with plural spaces 188 defined between the interior webs 187. A vertically elongated fastener slot 189 is defined by the interior webs 187 and the slot 189 communicates with a bottom portion 183. This unique configuration allows the shim 180 or plural shims 180 to be "inserted" between the structure exterior wall 13 and the rear portion (not shown) of the bracket isolator 30 after fasteners 15 have been engaged with the wall assembly 10 allowing re-plumbing of the exterior wall to vertical, and planar, at nearly any time after installation of the modular system. Thickness 190 of the shim 180, as measured between the front side 181 and the rear side (not shown) is less than the thickness (not shown) of the bracket isolator 30. The shim 180 is optionally positioned between the rear side (not shown) of the bracket isolator 30 and the exterior wall 13 providing a means to "re-plumb" the exterior wall to vertical and/or to establish a planar surface for a wall that may have warped or otherwise lost its planar configuration. The shim 180 may be used behind some bracket isolators 30 and not other bracket isolators 30 and it is contemplated the shims 180, which may be used singularly or in plurality (stacked) may also be used to provide desirable angulations to wall assemblies for aesthetic purposes as well as architectural purposes, such as for drainage and to minimize wind loads. The shims 180 may also have mating raised ridges (not shown) and indentation (not shown) on the front surface 181 and rear surface (not shown) to facilitate positionally secure "stacking" of plural shims 180.

Button 110 (FIG. 2) has the general configuration of a "washer" having an outer circumferential edge 111 and defines a central fastener hole 112. A shoulder (not shown) carried on one side of the button 110 has a diameter slightly smaller than diameter of the fastener hole 78 defined in the base 71 of the MFI-brackets 70 so that the shoulder (not shown) fits within the fastener hole 78 providing a secure and stable interconnection therebetween which prevents the button 110 from moving radially relative to the MFI-bracket 70 preventing any metal to metal contact between the MFI-bracket 70 and a fastener 15 and a washer 115 and securing the MFI-bracket 70 to the bracket isolator 30 and to the wall assembly 10.

Figures 12, 13:
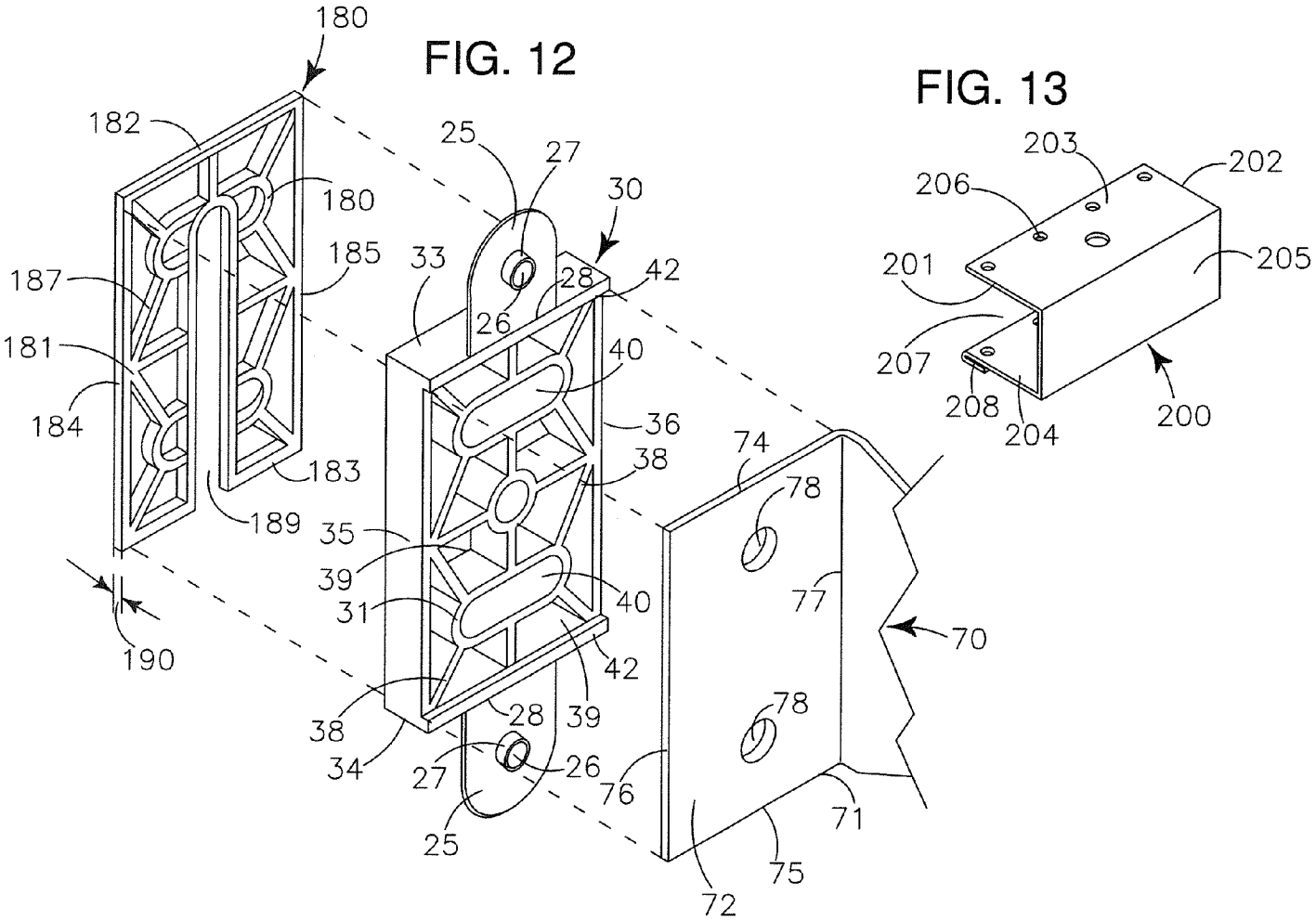
FIG. 12 is an enlarged partial cutaway exploded isometric front, top and side view of a MFI-bracket, second embodiment of a bracket isolator having washer ears and a shim showing how the components align.
FIG. 13 is an isometric front, top and end view of a rail splice.

In a second preferred embodiment, as shown in FIG. 12, the bracket isolator 30 may be formed/molded with a washer ear 25 extending upwardly from the top portion 33 adjacent the front side 31 and a similar washer ear 25 extending downwardly from the bottom portion 34 adjacent the front side 31. Each washer ear 25 defines a fastener hole 26 having a shoulder 27 extending circumferentially thereabout. The shoulder 27 has an exterior diameter (not shown) that fits within the fastener hole 78 defined by the MFI-bracket 70 base portion 71. Each washer ear 25 is sized and configured to bend forwardly relative to the bracket isolator 30 at fold line 28 and the fastener hole 26 and shoulder 27 are positioned on the washer ear 25 relative to fold line 28 so that when the washer ear 25 is bent forwardly 180 degrees to lie flat immediately against the front portion 72 of the base 71, the shoulder 27 passes into and engages with the fastener hole 78 defined in the MFI-bracket 70 base 71. The shoulder 27 prevents any metal to metal contact between the fastener 15 and the MFI-bracket 70 and the washer ears 25 eliminate the need for a separate thermally isolating button 110 (FIG. 2) and further reduces the number of individual pieces comprising the modular system and reduces the number of components an installer must handle when installing the modular system increasing efficiency and reducing cost and time and labor.

Figure 8:
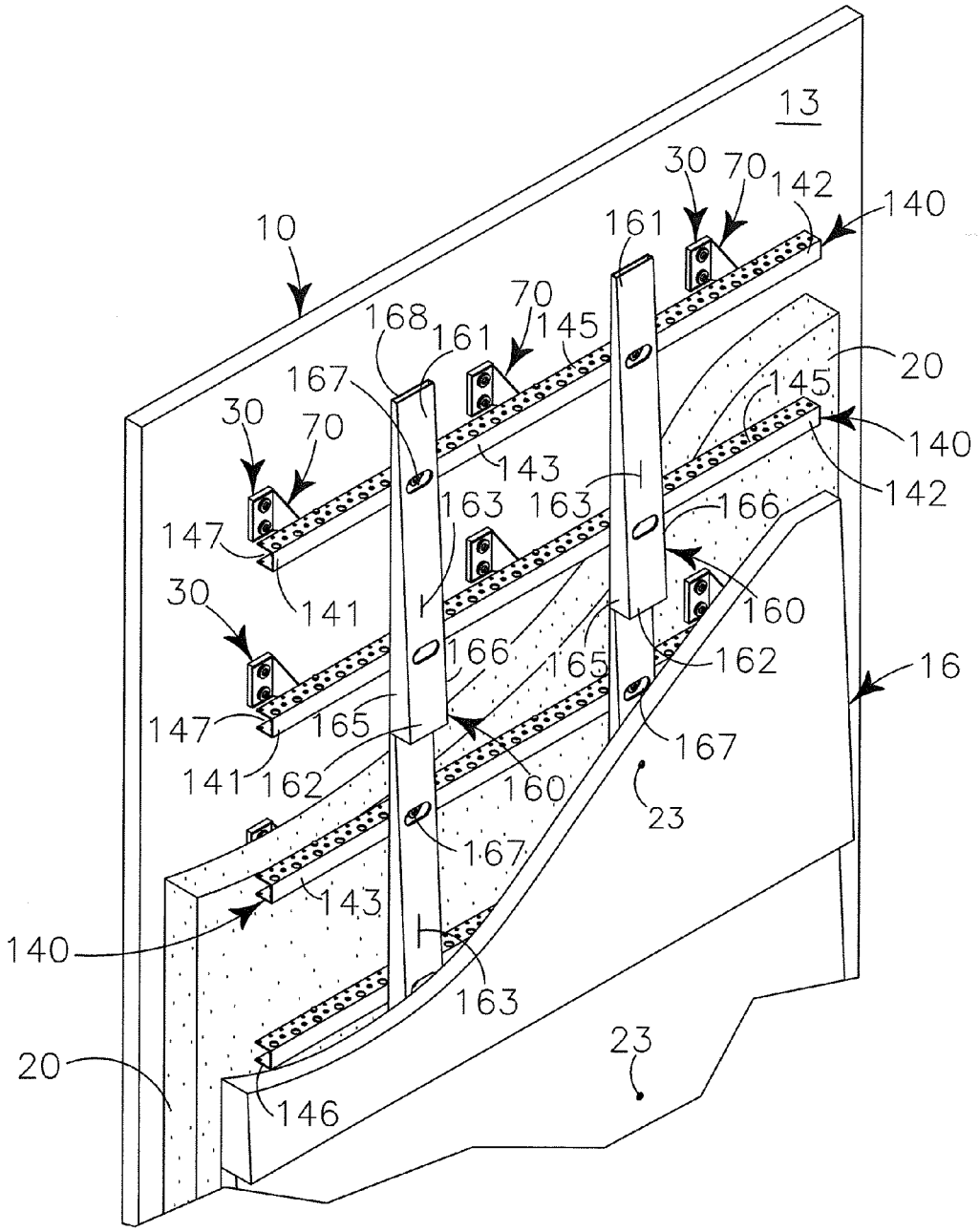
FIG. 8 is an isometric partial cutaway view of a wall assembly, similar to that of FIG. 1, showing lap siding supports carried on horizontal rails supported by plural MFI-brackets supporting exterior lap board type cladding.

Vertical rail 120 (FIG. 1) and horizontal rail 140 (FIG. 8) are similar in configuration. Each are elongate having a first end portion 121, 141 and a second end portion 122, 142. The rails 120, 140 may have a cross-sectional configuration similar to that of a "U" having front portion 123, 143 a first lateral side portion 125, (top portion 145) a second lateral side portion 126, (bottom portion 146) and define a channel 127, 147 therebetween. The first lateral side portion 125 (top portion 145) and the second lateral side portion 126 (bottom portion 146) define a plurality of spacedly arrayed fastener holes 128, 148 as well as plural spacedly arrayed ventilation holes 131, 151. Because the preferred embodiment vertical rail 120 and the preferred embodiment horizontal rail 140 are similar in configuration, the rails 120, 140 are interchangeable for interconnection with the MFI-brackets 70 and may be mounted vertically (FIG. 1) as well as horizontally (FIG. 8).

The channel 127, 147 defined by the rails 120, 140 has height/width and depth dimensions that correspond with the height, width and depth dimensions of the cap isolator 50. Fastener holes 128, 148, which are preferably "punched" into the rails 120, 140 are spacedly arrayed to align with the fastener slots 58 defined in the cap isolator 50 and the fastener holes 100 defined in the tip 89 and first upper wing 94 and second lower wing 97.

The ventilation holes 131, 151 may also be punched into the rails 120, 140 and the preferred location of the ventilation holes 131, 151 in the rails 120, 140 causes a portion of each ventilation hole 131, 151 to communicate with the bend (not shown) in the rail 120, 140 where the front portions 123, 143 communicate with the sides 125, 126 and top 145 and bottom 146 portions. This preferred location facilitates more effective drying of moisture and condensation and prevents moisture from collecting/condensing along an interior surface (not shown) of the bend (not shown) by providing effective drainage and air circulation.

The rails 120, 140 are thermally isolated from the MFI-bracket 70 by the cap isolator 50 which is carried therebetween about the tip 89 of the MFI-bracket 70. A threaded fastener 62 releasably attaches the rail 120, 140 to the MFI-brackets 70 by extending through one of the plurality of fastener holes 128, 148 defined in the rail 120, 140, through the fastener slot 58 defined by the cap isolator 50 and thereafter engaging with one of the spacedly arrayed fastener holes 100 defined in the tip end portion. 89, first upper wing 94 and/or second lower wing 97 of the MFI-bracket 70.

A rail splice 200 (FIG. 13) which has a configuration similar to the rails 120, 140 is used to securely interconnect adjacent end portions of the rails 120, 140. The rail spice 200 has a first end portion 201, a second end portion 202, a top portion 203, a bottom portion 204 and a front portion 205. A folded over friction lip 208 is carried by the bottom portion 204 along an elongate edge opposite the front portion 205. A medial channel 207 is defined between the top 203, bottom 204 and front 205 of the splice 205. is positioned within the channel 127, 147 defined by the rail 120, 140 and fasteners (not shown) are extended through the aligned fastener holes 128, 148, 206. Friction lip 208 carried by the rail splice 200 frictionally engages with a side 125, 126, top 145 or bottom 146 of the rail 120, 140 when the splice 200 is positioned within the channel 127, 147 defined by the rail 120, 140 to positionally maintain the splice 200 before fasteners (not shown) are engaged therewith.

The spacing arm 81 has a length 88 (FIG. 4) ranging from approximately two inches to approximately eight inches to space exterior cladding 16 outwardly from the exterior surface 13 of the wall assembly 10. The length 88 of the spacing arm 81, and the specific model of MFI-bracket 70 used, is influenced by relevant engineering calculations which include the thickness of insulation 20 that is to be installed on the structure. Insulation 20, including but not limited to mineral wool insulation is commonly available in a variety of thicknesses ranging from approximately 1 inch, to approximately 8 inches in thickness. The length 88 of the spacing arm 81 and the bends 95, 98 that form the first upper wing 94 and the second lower wing 97 assist in positionally maintaining the insulation 20 adjacent the structure exterior wall 13. The vertical rails 120 and the horizontal rails 140, when attached to the MFI-brackets 70 further positionally secure the insulation 20 adjacent to the structure exterior wall 13.

The vertical rails 120, and the horizontal rails 140, and more particularly the dimensions of the first lateral side 125, (top portion 145) and the second lateral side 126, (bottom portion 146) with the ventilation holes 131, 151 defined therein provide a ventilation channel between an interior facing surface of the exterior cladding 16 and the exterior facing surface of the insulation 20 which is positionally maintained against the wall assembly 10 by the MFI-brackets 70 and the rails 120, 140. Seams (not shown) between adjacent rolls, sheets, panels of insulation 20 are preferably vertically aligned with the MFI-brackets 70 as mounted on the wall assembly 10 to avoid any need to cut the insulation 20 which would add labor and cost for installation of the insulation 20 and the instant improved modular system. Known adhesive insulation tape (not shown) may be applied to the seams (not shown) between adjacent rolls, sheets, panels of the insulation 20 to prevent air flow through the seams. (not shown).

Figure 9:
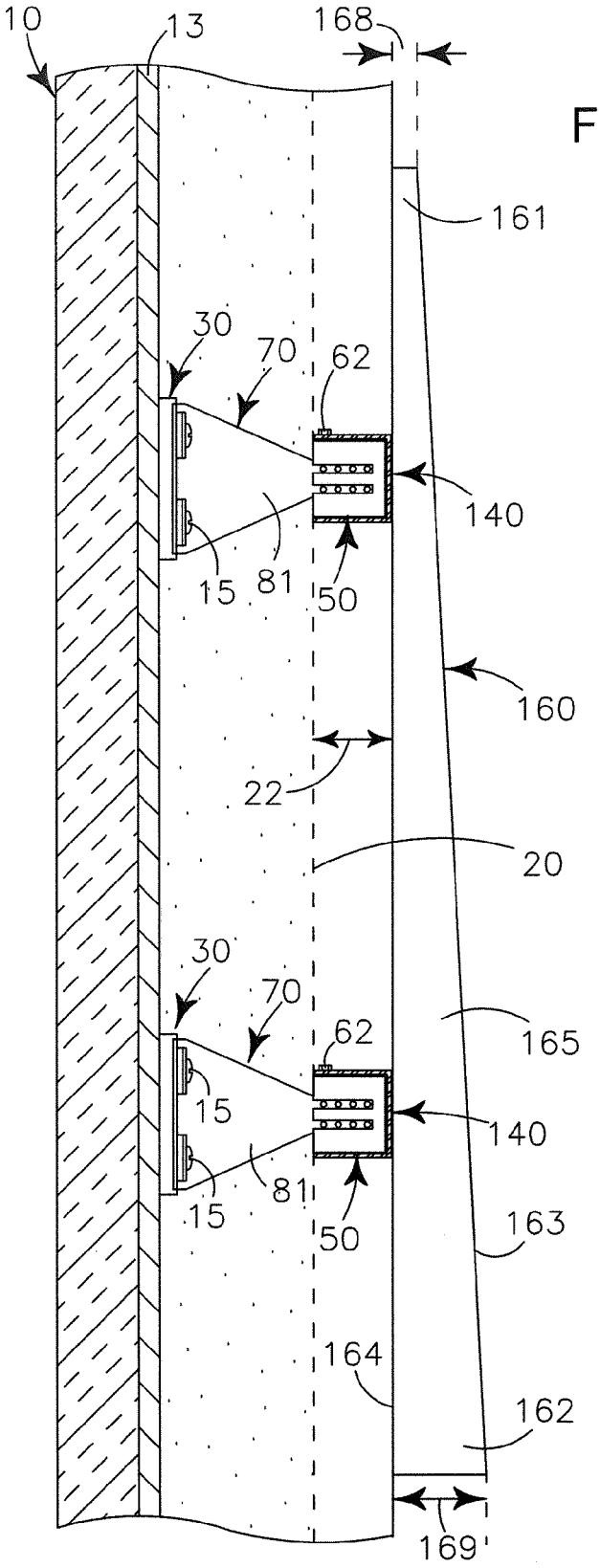
FIG. 9 is an orthographic cross section side view of MFI-brackets supporting horizontal rails and lap siding supports of FIG. 8 less the lap siding exterior cladding.
Figure 10:
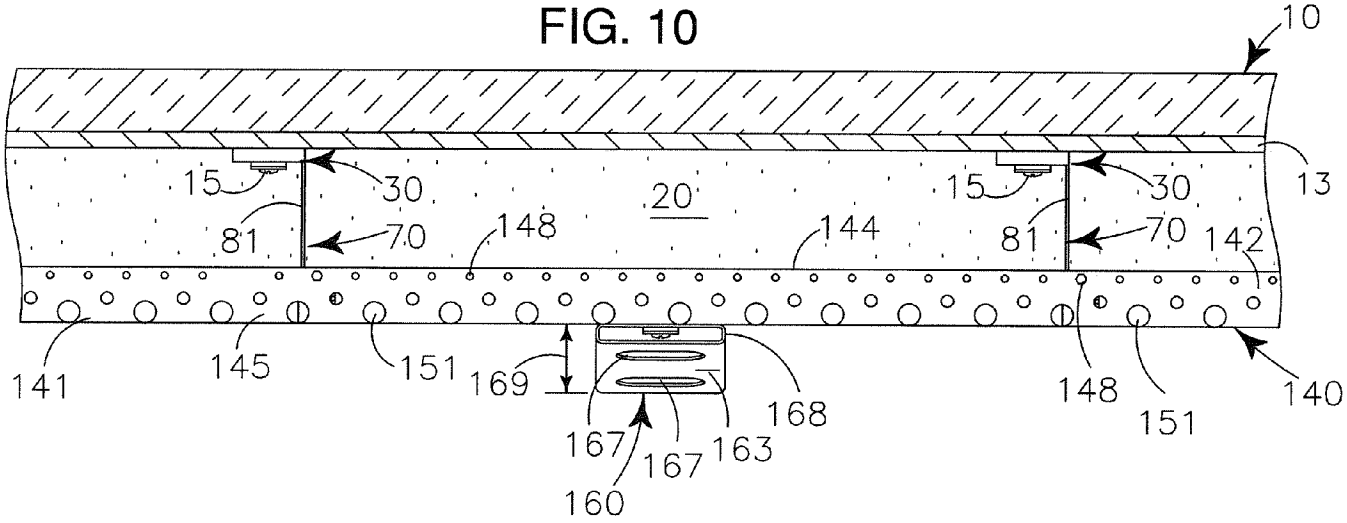
FIG. 10 is an orthographic top, downward looking view, of the wall assembly and lap siding supports of FIG. 9.
Figure 11:
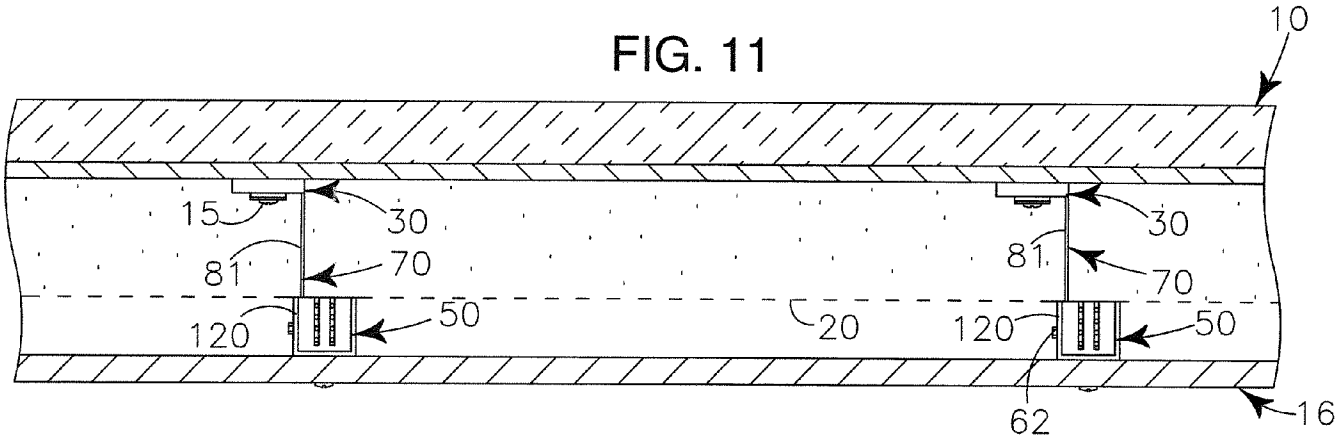
FIG. 11 is an orthographic top, downward looking view of a wall assembly similar to that of FIG. 5 showing exterior cladding fastened directly to the vertical rails.

In a further embodiment, as shown in FIG. 8 and FIG. 9, lap siding supports 160 may be releasably fastened to rails 120, 140 supported by the MFI brackets 70 attached to the wall assembly 10. Each lap siding support 160 has an upper end portion 161, a lower end portion 162, an exterior facing surface 163, an interior facing surface 164, a first lateral side 165, a second lateral side 166, a thickness 168 at the upper end portion 161, and a thickness 169 at the lower end portion 162. Spacedly arrayed aligned fastener holes 167 are defined in the exterior facing surface 163 and the interior facing surface 164 so that fasteners (not shown) may extend therethrough to secure the lap siding supports 162 the rails 120, 140. The fastener hole 167 defined in the exterior facing surface 163 is preferably horizontally elongated and is diametrically larger than the aligned fastener hole 167 defined in the interior facing surface 164 so that a thermally isolating washer (not shown) may be carried upon the fastener (not shown) securing the lap siding support 162 the rail 120, 140. The thickness 168 at the upper end portion 161 is less than the thickness 169 at the lower end portion 162 so that exterior cladding 16 secured to the lap siding supports 160 flares outwardly (toward the exterior) at the lower end portions thereof forming the aesthetical appeal of lap siding. Fasteners (not shown) that attach the lap siding supports 160 to the rails 140 are preferably self-tapping fasteners to avoid the need to pre-drill holes which further reduces time and expense of installation and allows a variety of sizes, widths, configurations of exterior cladding 16 to be fastened to the supports 160. Thickness (exterior surface to interior surface) of the lap siding exterior cladding 16 is preferably the same as the thickness 169 of the lower end portions 162 of the lap siding support 160 to prevent any gaps between vertically adjacent lap siding exterior cladding 16 elements which might allow moisture penetration or bug/insect penetration.

In one preferred embodiment (FIG. 1, FIG. 5) exterior cladding 16, is fastened directly to the front portion 123 of the vertical rail 120 or front portion 143 of the horizontal rail 140 with self tapping fasteners 23 extending through the exterior cladding 16 and engaging with the vertical rail 120 or horizontal rail 140. Other types of exterior cladding, including but not limited to panels, siding, OSB and other types of exterior cladding 16 may also be attached directly to the front portion 123 of the vertical rails 120 and front portion 143 horizontal rails 140 to provide exterior cladding 16 for the structure outward of the continuous insulation thereunder.

Figure 14:
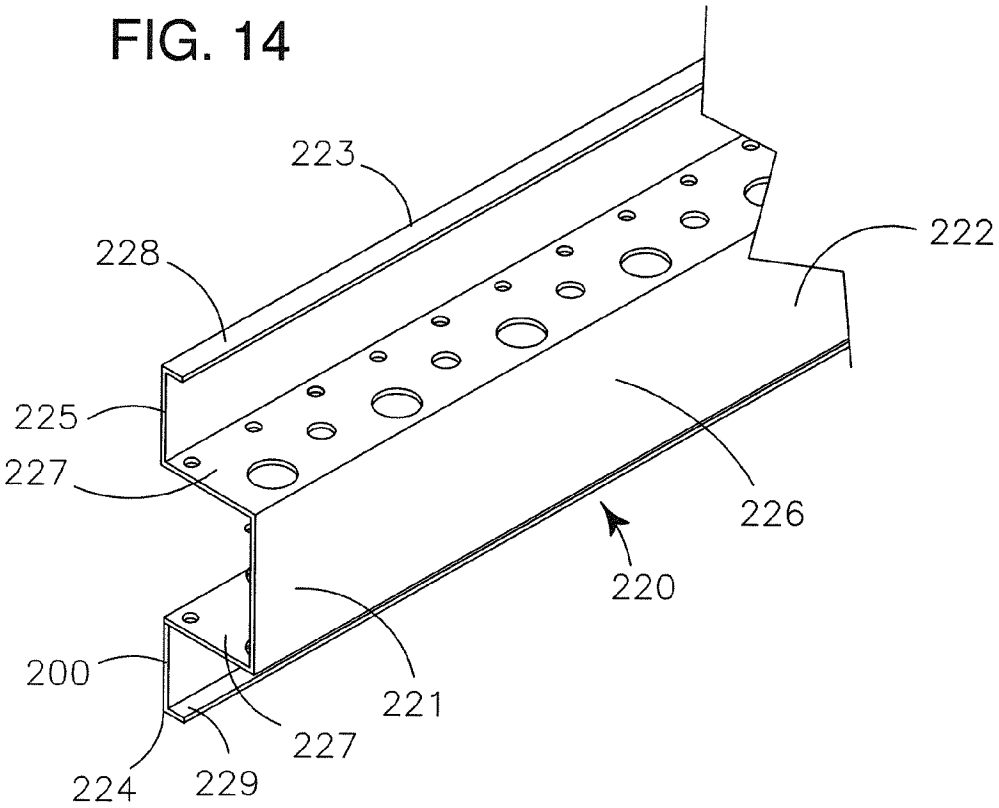
FIG. 14 is an isometric first end, rear and top view of a piece of channel rail.

In a still further embodiment (FIG. 14) panel rails 220 maybe fastened to vertical rails 120 to provide a means to attach cladding panels (not shown) to the modular system to clad the exterior of a structure. The panel rails 220 are somewhat similar in configuration to the rails 120, 140 each having a first end portion 221, a second end portion 222, a top edge 221, a bottom edge 224, a first side 225, a second side 226, an offset channel 227 and perpendicular lips 228, 229 carried at the top edge 221 and the bottom edge 222 extending laterally in the same direction as the offset channel 227. Plural spacedly arrayed ventilation holes 230 are defined in the panel rail 220. Panel rails 220 may be fastened to the front surface 123 of the vertical rails 120 with known fasteners (not shown) extending through the panel rail offset channel 227 and engaging with the vertical rail 120. When installed on the vertical rail 120 the top edge 221 and the bottom edge 222 are spaced laterally outwardly from the front surface 123 of the vertical rail 120 providing attachment locations for the cladding panel (not shown) and the perpendicular lip 228 at the top edge 223 provides an additional engagement feature for mounting a cladding panel (not shown).

It is well known that insulation 20 has the tendency to move toward the exterior cladding 16 within the wall assembly 10 due to gravity loads and wind loads that cause pressure changes, fluxuations and reductions within the wall assembly 10. The first and second wings 94, 97 respectively and the rails 120, 140 retain and positionally maintain insulation 20 immediately adjacent the exterior surface of the wall assembly 10 and spaced apart from the interior facing surface of the exterior cladding 16 to create and maintain a space 22 between the insulation 16 and the interior surface of the exterior cladding 16. Insulation clips (not shown) may also be attached to the vertical rails 120 and/or horizontal rails 140 to positionally maintain the insulation 20 frictionally against the wall assembly 10 and spaced apart from interior facing surface of the exterior cladding 16. Space 22 between the exterior facing surface of the insulation 20 and the interior facing surface of the exterior cladding 16 is known, in the industry, as a "rain screen" that prevents moisture from passing from the exterior of the structure to the insulation 20 and allows condensation to naturally occur and naturally dry within the wall assembly 10 without detrimentally affecting the wall assembly 10 and insulation 20.

Our modular system provides a means for adding insulation 20 to the exterior of a structure, it provides a means for mounting exterior cladding 16 on a structure and it provides a means to "plumb" an exterior clad wall assembly 10 to vertical and flatness.

Mounting exterior cladding 16 on a new structure, or refurbishing and adding insulation to the exterior of an existing structure is more economical using our improved system because of the additional adjustability features provided by the plurality of spacedly arrayed fastener holes 100 defined in the MFI-bracket 70 and the optional shims 180. The instant modular system is also more economical because of the interchangeability of the rails 120, 140 and the limited number of components that need to be individually handled by an installer due to the preassembly of the MFI-brackets 70, bracket isolators 30, isolator caps 50 at the manufacturer which reduces installation time and resulting cost.

Having described the structure of our modular system for cladding and insulating exterior walls of a structure, its operation may be understood.

The MFI-bracket 70 and bracket isolators 30 are preferably interconnected with one another at the time of manufacture to increase efficiency and to reduce installation time with the base 71 of the MFI-bracket 70 positionally secured to the front side 31 of the bracket isolator 30 with the edge lips 42 engaging with the top portion 74 and bottom portion 75 of the base 71 of the MFI-bracket 70 and the washer ears 25 folded forwardly over the base 71 to thermally isolate the fastener holes 78 from fasteners 15. Similarly the cap isolators 50 are preferably installed upon the MFI-bracket 70 tip portions 89 at the manufacturer and if washer ears 25 are not carried on the bracket isolator 30 the buttons 110 are attached to the base 71 about the fastener holes 78 at the manufacturer. Attachment of the thermally insulative members 30, 50, 110 to the MFI brackets 70 at the manufacturer increases the efficiency of our system by reducing the number of individual components, and reducing labor time required to install the modular system.

The MFI-brackets 70 and bracket isolators are mapped to a structure exterior wall 13 with the plural MFI-brackets 70 vertically and horizontally aligned so that the fastener holes 78 defined in the base portions 71 are aligned with the wall studs 14 or other structural elements (not shown) of the wall assembly 10. It is imperative that the MFI-brackets 70 be vertically aligned and horizontally aligned to engage with and support the vertical rails 120 or horizontal rails 140.

Fasteners 15 are extended through the fastener hole 26 defined in the washer ear 25 through the fastener holes 78 defined in the MFI brackets 70 and through the fastener holes 40 defined in the bracket isolator 30. The fastener 15 thereafter penetrates the wall assembly 10 and engages with a wall stud 14 or other structural element (not shown) to provide vertical and horizontal support for the MFI bracket 70 and components connected therewith.

The number of MFI-brackets 70 installed on the structure to support the exterior cladding 16 is dependent upon engineering calculations that take into account the weight of the exterior cladding 16, predicted wind loads, traffic vibration, and the like. Because the MFI-brackets 70 interrupt the insulation 20 and affect the performance of the insulation 20 it is preferable to use the minimum number of MFI-brackets 70 that will safely meet required engineering load calculations and safety tolerances.

The process of installing MFI-brackets 70 is continued so that the MFI-brackets 70 are spacedly arrayed and extend from the lowest desired level, to the upper-most desired level of the structure and are spacedly arrayed on the exterior wall 13 in a configuration that will support the rails 120, 140.

After the MFI-brackets 70 have been secured to the exterior wall 13 of the structure, the vertical rails 120 or horizontal rails 140, whichever is to be used to support the exterior cladding 16, are positioned so that the channels 127, 147 defined by the rails 120, 140 respectively fit over and about the cap isolators 50 carried on the tip ends 89 of the MFI-brackets 70. The fastener holes 128, 148 defined in the rails 120, 140 are aligned with the fastener holes 100 defined in the tip 89 and wings 94, 97 of the MFI-bracket 70 and the fastener slots 58 of the cap isolator and fasteners 62 are engaged therewith.

Because rail 120, 140 is thermally isolated from the MFI-bracket 70 by the cap isolator 50, the only metal to metal contact is the fastener 62 securing the rail 120, 140 to the MFI-bracket 70. This minimal metal to metal contact greatly reduces thermal transfer from the rail 120, 140 to the MFI-bracket 70 and visa-versa.

Similar fasteners 62 are inserted through the remaining fastener holes 128, 148 defined in the rails 120, 140, through the fastener slots 58 in the cap isolators 50 and into the fastener holes 100 defined in the MFI-bracket 70 securing the rails 120, 140 to the MFI-brackets 70.

Before the fasteners 62 interconnecting the rails 120, 140 and MFI-brackets 70 are tightened, adjustments should be made to ensure that the vertical rails 120 are vertical, and the horizontal rails 140 are not bowed inwardly or outwardly resulting from non-planer wall assemblies 10. The adjustment is made by adjusting the position of the rails 120, 140 relative to the MFI-bracket 70 by moving the rail 120, 140 more proximate to, or more distal from the exterior wall 13 of the structure which responsively changes the angle of the rail 120, 140 relative to the wall 13. If the vertical plumbness of the vertical rail 120 or the planar nature of the horizontal rail 140 cannot be established using one or more of the plurality of fastener holes 100 defined in the MFI brackets 70 one or more shims 180 may be inserted between the back portion (not shown) of the bracket isolator 30 and the exterior wall 13 to space the bracket isolator 30 and the MFI brackets 70 further away from the exterior wall 13. The fasteners 15 extending through the fastener holes 78 and securing the MFI brackets 70 and bracket isolators 30 to the exterior wall 13 need not be completely removed, but rather need only be loosened sufficiently to allow the shim 180 to be inserted between the bracket isolator 30 and the exterior wall 13. The vertically elongated fastener slots 189 defined in the shim 180 allows the shim 180 to be positioned adjacent above the bracket isolator 30 with the vertically elongated slot 189 aligned with the fasteners 15 and the opening to the vertically elongated fastener slot 189 opening downwardly. Thereafter, the shim 180 may be moved vertically downwardly immediately adjacent the exterior wall 13 so that the fasteners 15 pass into the vertically elongated fastener slot 189 until the shim 180 is positioned immediately behind the bracket isolator 30. Thereafter the fasteners 15 may be retightened to secure the MFI-brackets 70, the bracket isolator 30 and the shim 180 to the exterior wall 13. Plumbness is then checked again. If necessary, additional shims 180 may be installed as necessary behind various bracket isolators 30 to replumb the wall to vertical and/or planar.

Insulation 20, such as, but not limited to mineral wool, is installed adjacent the exterior wall 13 to extend completely between the spaced apart MFI-brackets 70. The wings 94, 97 of the MFI-brackets 70 as well as the rails 120, 140 retain and positionally maintain the insulation 20 immediately adjacent the exterior wall 13 and prevent the insulation 20 from expanding or moving outwardly toward the interior facing surface of the wall cladding 16 to maintain the rain screen 22. If desired, insulation clips (not shown) may be attached to the rails 120, 140 to extend rearwardly therefrom toward the interior of the structure to positionally maintain the insulation 20 in direct physical contact with the exterior wall 13 and spaced apart from the interior facing surface of the exterior cladding 16. A known type of adhesive insulation tape (not shown) may be applied to the insulation 20 to extend over and across any seams (not shown) between adjacent rolls, pieces, panels of the insulation 20 to prevent air flow through the seams. (not shown). Thereafter, the exterior cladding 16 may be fastened directly to the front side portions 123, 143 of the rails 120, 140 with fasteners 23 extending therethrough, or lap siding supports 160 may be attached to the front side portion 143 of the rails 120, 140 with known fasteners and thereafter lap siding may be attached to the lap siding supports 160, similar to the process described above.

If exterior cladding 16 such as lap board, or metal sheeting, is to be fastened directly to the front portion 123, 143 of the vertical rails 120 or horizontal rails 140 the exterior cladding 16 may be placed directly against the front portion 123, 143 and self tapping fasteners 23 are used to attach the exterior cladding 16 by passing the fasteners 23 through the exterior cladding 16 and engaging the vertical rail 120 or horizontal rail 140.

The vertical and horizontal spacing of the vertical rails 120, and horizontal rails 140 is dependent upon the spacing of the MFI-brackets 70 and is preferably the same as or an evenly spaced portion of the height and width dimensions of the elements of exterior cladding 16 so each element of exterior cladding 16 engages with plural rails 120, 140.

Having thusly described our invention, what we desire to protect by Utility Letters Patent and

What we claim is:

1. A modular system for continuously insulating exterior walls of a structure and supporting exterior cladding on the structure comprising in combination:

plural brackets fastened to a structure exterior wall in spaced array, each bracket having a base portion, a spacing arm extending perpendicularly from the base portion and a tip portion spaced apart from the base portion, the tip portion defining at least one fastener hole;

a bracket isolator communicating with rear surface of the base portion opposite the tip portion to thermally isolate the bracket from the structure wall;

a fastener extending through aligned holes defined in the base portion and the bracket isolator to engage with the exterior structure wall to attach the bracket and bracket isolator thereto, the fastener thermally isolated from the bracket;

a cap isolator carried on the tip portion to thermally isolate the tip portion from a rail carried at the tip portion, the rail having, a first end portion, a spaced apart second end portion, a top portion, a front portion, and a bottom portion spaced apart from the top portion, and defining a channel between the top portion and the bottom portion, the channel configured to communicate with the cap isolator carried by the tip portion so that the rail is thermally isolated from the tip portion;

thermally insulating material positionally maintained adjacent the structure exterior wall by the rails; and exterior cladding supported by the rails and spaced apart from the thermally insulating material creating a rainscreen between a portion of the exterior cladding proximate the structure wall and a portion of the thermally insulating material distal from the structure exterior wall.

2. The modular system of claim 1 wherein:

the spacing arm tapers from the base portion toward the tip portion to reduce surface area and to reduce thermal conductivity from the tip portion to the base portion and from the base portion to the tip portion.

3. The modular system of claim 1 further comprising:

an upper wing extending perpendicularly from an upper portion of the tip portion in a direction opposite the base portion;

a lower wing extending perpendicularly from a lower portion of the tip portion in a direction opposite the base portion and generally parallel to the upper wing;

plural spacedly arrayed fastener holes defined in the tip portion, the upper wing and the lower wing to provide adjustability in mounting the rail; and elongate slots defined in the cap isolator that align with the plural spacedly arrayed fastener holes defined in the tip portion, the upper wing and the lower wing for a fastener to extend therethrough to secure the rail to the tip portion.

4. The modular system of claim 1 further comprising:

a shim adjustably positionable between the structure wall and the bracket isolator to space the bracket and bracket isolator from the structure wall, the shim having an elongated fastener slot communicating with one end portion of the shim to permit installation of the shim between the bracket isolator and the structure wall without removal of the fasteners.

5. The modular system of claim 1 wherein:

the bracket isolator carries a washer ear at a top edge portion and a washer ear at a lower edge portion each washer ear having, a fastener hole defined therein, and a shoulder extending circumferentially about the fastener hole; and the washer ear is configured to fold toward the base portion of the bracket so that when folded to a position immediately adjacent the base portion, the fastener hole and shoulder engage with the fastener hole defined in the bracket base portion to completely thermally isolate the fastener extending therethrough from the bracket.

6. The modular system of claim 1 further comprising:

a lap siding support to secure lap siding type exterior cladding to the rails, the lap siding support having, an upper end portion having a first front-to-back thickness, a spaced apart lower end portion having a second front-to-back thickness, a front surface, a rear surface and plural spacedly arrayed aligned fastener holes defined in the front surface and rear surface with the fastener hole defined in the front surface diametrically larger than the aligned fastener hole defined in the rear surface; and the first thickness is less than the second thickness.

7. The modular system of claim 1 wherein:

the exterior cladding supported by the modular system is completely thermally isolated from the structure exterior wall.

8. The modular system of claim 1 further comprising:

panel rails releasably attached to plural vertically oriented rails to extend horizontally across the rails and generally parallel to the structure exterior wall, each panel rail having, a first end portion and an opposing second end portion, a first side portion adjacent the front portion of the rails, a second side portion opposite from and parallel to the first side portion adjacent the rails, an offset channel defined in the panel rail extending from the first end portion to the second end portion and a generally medially between an upper edge and a spaced apart lower edge, and the upper edge provides a hanging edge for a wall panel; and plural wall panels that releasably engage with the hanging edge of the panel rails to depend from the panel rails to provide exterior cladding to the structure.

9. The modular system of claim 1 wherein:

the bracket isolator is formed of polyoxymethylene.

10. The modular system of claim 1 wherein:

the thermally insulating material is mineral wool.

11. The modular system of claim 1 wherein:

the exterior cladding is fastened directly to the rails.

12. The modular system of claim 1 wherein:

the modular system provides a continuously insulated wall assembly that satisfies ASHREA 90.1 definition for continuous insulation.

13. The modular system of claim 1 wherein:

plural spacedly arrayed fastener holes are defined in the tip portion; and the rails may be adjustably positioned relative to the bracket to adjust the angle and position of the rails and exterior cladding relative to the structure wall.

14. A method of installing cladding on an exterior structure wall and continuously insulating the structure wall comprising the steps of:

providing thermally insulating material for positioning adjacent a structure exterior wall;

providing plural brackets for attachment to the structure wall in spaced array, each bracket having a base portion, a spacing arm extending perpendicularly from the base portion and tapering toward a tip portion opposite the base portion, the tip portion having an upper wing and the lower wing and defining plural spacedly arrayed fastener holes;

providing bracket isolators positioned between a rear surface of the bracket base portions and the structure wall;

providing fasteners to extend through aligned fastener holes defined in the bracket base portion and bracket isolator to secure the bracket and bracket isolator to the structure wall;

providing thermal isolators communicating with the fasteners and with a front surface of the bracket base portion opposite the bracket isolator to thermally isolate the fastener from the bracket and to minimize thermal transfer from the fastener to the structure wall;

providing a cap isolator carried on the tip portion to thermally isolate the bracket from a rail carried thereon;

providing a rail having a first end portion, a spaced apart second end portion, a top portion, a front portion, and a bottom portion spaced apart from the top portion, and defining a channel between the top portion and the bottom portion, the channel configured to communicate with the cap isolator so that the rail is thermally isolated from the tip portion; and providing exterior cladding supported by the rails and spaced apart from the thermally insulating material creating a rainscreen between a portion of the exterior cladding proximate the structure wall and a portion of the thermally insulating material distal from the structure wall.

15. The method of installing cladding on an exterior structure walls and continuously insulating the structure walls of claim 14 wherein:

the insulating material is mineral wool having an inner surface and an opposing outer surface, and the inner surface is adjacent the structure wall, and fasteners attaching the brackets to the structure wall do not penetrate through the insulating material.

16. A continuously insulated wall assembly that supports exterior cladding on a structure's exterior walls comprising in combination:

plural brackets fastened to a structure exterior wall in spaced array, each bracket having, a generally planar base portion defining a fastener hole, a spacing arm extending perpendicularly from the base portion that tapers from the base portion toward a tip portion to reduce surface area and to reduce thermal conductivity from the tip portion to the base portion and from the base portion to the tip portion, a tip portion spaced apart from the base portion, the tip portion having an upper wing extending perpendicularly from an upper portion of the tip portion in a direction opposite the base portion and a lower wing extending perpendicularly from a lower portion of the tip portion in a direction opposite the base portion and plural spacedly arrayed fastener holes defined in the tip portion, the upper wing and the lower wing to provide adjustability in mounting the rail;

a bracket isolator communicating with rear surface of the base portion opposite the tip portion to thermally isolate the bracket from the structure wall, the bracket isolator carrying a washer ear at a top edge portion and a washer ear at a lower edge portion, the washer ears configured to fold toward the base portion of the bracket proximate the tip portion, each washer ear defining a fastener hole therein with a shoulder extending circumferentially about the fastener hole and position of the fastener hole and shoulder on the washer ear provides that when the washer ear is folded to a position immediately adjacent the base portion, the fastener hole and shoulder engage with the fastener hole defined in the base portion to completely thermally isolate a fastener extending through the fastener hole from the bracket;

a fastener extending through aligned holes defined in the base portion and the bracket isolator to engage with the structure wall to attach the bracket and bracket isolator thereto, the fastener thermally isolated from the bracket;

a cap isolator carried on the tip portion to thermally isolate the bracket from the rail, the cap isolator having elongate slots defined in the cap isolator that align with the plural spacedly arrayed fastener holes defined in the tip portion, the upper wing and the lower wing for a fastener to extend therethrough securing the rail to the tip portion;

a rail having a first end portion, a spaced apart second end portion, a top portion, a front portion, and a bottom portion spaced apart from the top portion, and defining a channel between the top portion and the bottom portion, the channel configured to communicate with the cap isolator carried by the tip portion so that the rail is thermally isolated from the tip portion;

thermally insulating material positionally maintained adjacent the structure wall by the rails; and exterior cladding supported by the rails and spaced apart from the thermally insulating material creating a rainscreen between a portion of the exterior cladding proximate the structure wall and a portion of the thermally insulating material distal from the structure wall;

a shim adjustably positionable between the structure wall and the bracket isolator to space the bracket and bracket isolator from the structure wall, the shim having an elongated fastener slot communicating with one end portion of the shim to permit installation of the shim between the bracket isolator and the structure wall without removal of the fasteners; and the modular system provides a continuously insulated wall assembly that satisfies ASHREA definition for continuous insulation.

17. The continuously insulated wall assembly of claim 16 further comprising:

a lap siding support to secure the lap siding type exterior cladding to the rails, the lap siding support having, an upper end portion having a first front-to-back thickness, a spaced apart lower end portion having a second front-to-back thickness, a front surface, a rear surface and plural spacedly arrayed aligned fastener holes defined in the front surface and rear surface with the fastener hole defined in the front surface diametrically larger than the aligned fastener hole defined in the rear surface, and the first thickness is less than the second thickness.

18. The continuously insulated wall assembly of claim 16 wherein:

the exterior cladding supported by the modular system is completely thermally isolated from the structure exterior wall.

19. The continuously insulated wall assembly of claim 16 wherein:

panel rails releasably attached to the plural vertically oriented rails extend horizontally across the rails and generally parallel to the structure wall, each panel rail having, a first end portion and an opposing second end portion, a side portion adjacent the front portion of the rails, a side portion opposite from and parallel to the side portion adjacent the rails, an offset channel defined in the panel rail extending from the first end portion to the second end portion and a generally medially between an upper edge and a spaced apart lower edge, and the upper edge provides a hanging edge for a wall panel; and plural wall panels that releasably engage with the hanging edge of the panel rails to depend from the panel rails to provide exterior cladding to the structure.

20. A modular system accommodating continuous insulation of an exterior wall of a structure, comprising:

multiple brackets attachable to the exterior wall in a spaced array, each bracket including a base portion for attachment to the exterior wall, a spacing arm extending away from the base portion, and a tip portion spaced apart from the base portion by the spacing arm;

multiple rails spaced apart from the base portions and attached to the tip portions of the multiple brackets, each rail attached to a different group of the multiple brackets and defining a channel; and multiple cap isolators positioned between the multiple rails and the tip portions of the multiple brackets to thermally isolate the multiple brackets from the multiple rails, each cap isolator defining a cavity in which the tip portion of a respective bracket is received, each cap isolator received in the channel defined by a respective rail.

21. The modular system of claim 20 wherein:

the tip portion of each bracket defines spacedly arrayed fastener holes;

each cap isolator defines fastener slots aligned with the fastener holes of the tip portion of a respective bracket; and each rail defines spacedly arrayed fastener holes aligned with the fastener holes defined in the tip portions of respective brackets and the fastener slots defined in respective cap isolators.

22. The modular system of claim 20 wherein the multiple rails are oriented either horizontally or vertically.

23. An apparatus for use in a modular system for continuously insulating an exterior wall of a structure and supporting exterior cladding on the structure, the apparatus comprising:

a bracket configured to be fastened to the exterior wall, the bracket comprising a base portion, a spacing arm connected directly to and extending perpendicularly from the base portion, and a tip portion spaced apart from the base portion; wherein the base portion defines at least one hole configured to receive a fastener to fasten the bracket to the exterior wall, and wherein the spacing arm tapers inwardly from the base portion toward the tip portion;

wherein the bracket further includes an upper wing spaced apart from the base portion and extending perpendicularly from an upper portion of the tip portion and a lower wing spaced apart from the base portion and extending perpendicularly from a lower portion of the tip portion parallel to the upper wing;

wherein the tip portion, upper wing, and lower wing are arranged to carry a rail about an outer surface of the bracket defined by the tip portion, upper wing, and lower wing; and wherein the upper wing and the lower wing extend from the tip portion in a direction opposite the base portion; and at least one isolator component formed of a thermally insulative material, wherein the at least one isolator component is selected from:

a bracket isolator attached to the bracket and adjacent to at least one side of the base portion such that the bracket isolator is positioned between the bracket and the exterior wall when the bracket is fastened to the exterior wall; and a cap isolator configured to fit about the outer surface of the bracket and configured to be attached to the bracket such that it is positioned between the outer surface of the bracket and the rail.

24. The apparatus of claim 23 wherein the upper wing and the lower wing are planar.

25. The apparatus of claim 23 wherein the upper wing and the lower wing each extend perpendicularly to the base portion.

26. The apparatus of claim 23 wherein the upper wing and the lower wing each define multiple fastener holes arranged in a spaced array.

27. The apparatus of claim 23 wherein the tip portion defines multiple fastener holes arranged in a spaced array.

28. The apparatus of claim 23 wherein the tip portion is coplanar with the spacing arm.

29. The apparatus of claim 23 wherein the tip portion extends perpendicularly to the base portion.

30. The modular system of claim 20 further comprising:

an upper wing extending perpendicularly from an upper portion of the tip portion; and a lower wing extending perpendicularly from a lower portion of the tip portion parallel to the upper wing.

31. The modular system of claim 30 wherein the upper wing and the lower wing each define multiple fastener holes arranged in a spaced array.

32. The modular system of claim 20 further comprising:

multiple bracket isolators positionable along rear surfaces of the base portions opposite the tip portions to thermally isolate the brackets from the exterior wall.

33. The modular system of claim 32 further comprising:

multiple adjustable shims positionable between the exterior wall and the bracket isolators, wherein each shim has an elongated fastener slot communicating with one end portion of the shim.

34. The modular system of claim 32 wherein:

each bracket isolator has a foldable first washer ear at a top edge portion and a foldable second washer ear at a lower edge portion, each washer ear having a fastener hole defined therein and a shoulder extending circumferentially about the fastener hole.

35. The modular system of claim 20 further comprising:

lap siding supports attached to the multiple rails, each lap siding support having an upper end portion and a lower end portion, wherein a thickness at the upper end portion is less than a thickness at the lower end portion so that the lower end portion flares outwardly relative to the upper end portion.

36. The modular system of claim 21 wherein each rail further defines ventilation holes.

37. The modular system of claim 20 wherein the channels defined by the rails have dimensions that correspond with dimensions of the cap isolators.

38. The apparatus of claim 23, wherein the at least one isolator component is removably attached to the bracket.

* * * * *